US009427976B2

(12) United States Patent
Nakai et al.

(10) Patent No.: US 9,427,976 B2
(45) Date of Patent: Aug. 30, 2016

(54) PRINTING APPARATUS, PRINTING SYSTEM, AND PRINTED MATERIAL MANUFACTURING METHOD

(71) Applicants: Junji Nakai, Kanagawa (JP); Hiroyoshi Matsumoto, Kanagawa (JP)

(72) Inventors: Junji Nakai, Kanagawa (JP); Hiroyoshi Matsumoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/793,943

(22) Filed: Jul. 8, 2015

(65) Prior Publication Data

US 2016/0009107 A1 Jan. 14, 2016

(30) Foreign Application Priority Data

Jul. 10, 2014 (JP) ..... 2014-142604
May 7, 2015 (JP) ..... 2015-095040

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
CPC ..... B41J 2/24; B41J 11/009; B41M 5/52; B41M 5/5218; B41M 5/5254; B41M 5/506; B41M 5/508; B41M 7/00
USPC ..... 347/102
See application file for complete search history.

(56) References Cited

U.S. PATENT DOCUMENTS 9,108,437 B2 * 8/2015 Hirose ..... B41M 5/0011
2014/0078212 A1 3/2014 Nakai et al.
2014/0160197 A1 6/2014 Hirose et al.
2015/0035918 A1 2/2015 Matsumoto et al.
2015/0077458 A1 3/2015 Osanai et al.
2015/0251453 A1 9/2015 Nakai et al.
2015/0258814 A1 9/2015 Matsumoto et al.

(Continued)

FOREIGN PATENT DOCUMENTS

JP 2000-290548 10/2000
JP 2010-058404 3/2010

(Continued)

OTHER PUBLICATIONS

European Search Report for Application No. 15175682.2-1701/2974871 dated Mar. 9, 2016.

(Continued)

*Primary Examiner* — Julian Huffman
*Assistant Examiner* — Sharon A Polk
(74) *Attorney, Agent, or Firm* — Duft Bornsen & Fettig LLP

(57) ABSTRACT

A printing apparatus includes: a plasma processing unit that performs plasma processing on a processing target surface side of a processing object; a recording unit that ejects ink on the processing target surface side of the processing object; an acquiring unit that acquires setting information, in which an adjustment target area for adjusting surface roughness and surface roughness of the adjustment target area on a surface of an ink layer formed with the ink are set; and a plasma control unit that controls the plasma processing unit to perform plasma processing on a processing area corresponding to the adjustment target area, on the processing target surface side of the processing object, with an amount of plasma energy for obtaining the set surface roughness on the surface of the ink layer formed on the processing area.

8 Claims, 17 Drawing Sheets

(56) References Cited

U.S. PATENT DOCUMENTS

2015/0266311 A1 9/2015 Hirose et al.
2015/0266312 A1 9/2015 Yamanaka et al.

FOREIGN PATENT DOCUMENTS

JP 2012-179747 9/2012
JP 2012-179748 9/2012

OTHER PUBLICATIONS

Miettinen J. et al., Inkjet printed System-in-Package design and manuafacturing, Mircoelectronics Journal, Mackintosh Publications Ltd. Luton GB, vol. 39, No. 12, Apr. 2, 2008.

* cited by examiner

FIG.22

| | | |
|---|---|---|
| RESOLUTION 600dpi | SMALL DROPLET [pl] | 2.5 |
| | MEDIUM DROPLET [pl] | 6.5 |
| | LARGE DROPLET [pl] | 15 |
| RESOLUTION 1200dpi | SMALL DROPLET [pl] | 2 |
| | MEDIUM DROPLET [pl] | 4 |
| | LARGE DROPLET [pl] | 6 |

FIG.23

| AMOUNT OF INK [pl] | PAPER TYPE [J/cm$^2$] | | | | | | |
|---|---|---|---|---|---|---|---|
| | PLAIN PAPER A | PLAIN PAPER B | COATED PAPER A | COATED PAPER B | COATED PAPER C | FILM A | FILM B |
| 2 | 0.07 | 0.1 | 0.14 | 0.5 | 1 | 0.07 | 0.14 |
| 2.5 | 0.07 | 0.1 | 0.14 | 0.5 | 1 | 0.07 | 0.14 |
| 4 | 0.08 | 0.12 | 0.7 | 1.4 | 2.8 | 0.08 | 0.16 |
| 6 | 0.08 | 0.12 | 0.7 | 1.4 | 2.8 | 0.08 | 0.16 |
| 6.5 | 0.08 | 0.12 | 0.7 | 1.4 | 2.8 | 0.08 | 0.16 |
| 15 | 0.1 | 0.14 | 1.4 | 2.5 | 5 | 0.1 | 0.2 |

PRINTING APPARATUS, PRINTING SYSTEM, AND PRINTED MATERIAL MANUFACTURING METHOD

CROSS-REFERENCE TO RELATED APPLICATION(S)

The present application claims priority to and incorporates by reference the entire contents of Japanese Patent Application No. 2014-142604 filed in Japan on Jul. 10, 2014 and Japanese Patent Application No. 2015-095040 filed in Japan on May 7, 2015.

BACKGROUND OF THE INVENTION

1. Field of the Invention

The present invention relates to a printing apparatus, a printing system, and a printed material manufacturing method.

2. Description of the Related Art

A process of generating plasma and making the surface of a recording medium hydrophilic has been disclosed (for example, Japanese Laid-open Patent Publication No. 2012-179747). Japanese Laid-open Patent Publication No. 2012-179747 discloses a technique to make the surface of a recording medium hydrophilic regardless of the thickness of the recording medium by moving a plasma generator in the thickness direction of the recording medium.

However, conventionally, it is difficult to adjust surface roughness on the surface of an ink layer formed on a processing object, such as a recording medium.

SUMMARY OF THE INVENTION

It is an object of the present invention to at least partially solve the problems in the conventional technology.

A printing apparatus includes: a plasma processing unit that performs plasma processing on a processing target surface side of a processing object; a recording unit that ejects ink on the processing target surface side of the processing object; an acquiring unit that acquires setting information, in which an adjustment target area for adjusting surface roughness and surface roughness of the adjustment target area on a surface of an ink layer formed with the ink are set; and a plasma control unit that controls the plasma processing unit to perform plasma processing on a processing area corresponding to the adjustment target area, on the processing target surface side of the processing object, with an amount of plasma energy for obtaining the set surface roughness on the surface of the ink layer formed on the processing area.

A printing system includes: an image processing apparatus; and a printing apparatus capable of communicating with the image processing apparatus. The image processing apparatus includes: a receiving unit that receives setting information containing an adjustment target area for adjusting surface roughness and surface roughness of the adjustment target area on a surface of an ink layer formed on a processing target surface side of a processing object; and a generating unit that generates print data containing the setting information and image data of an image formed with ink. The printing apparatus includes: a plasma processing unit that performs plasma processing on the processing target surface side of the processing object; a recording unit that ejects ink to the processing target surface side of the processing object based on the image data; an acquiring unit that acquires the setting information; and a plasma control unit that controls the plasma processing unit to perform plasma processing on a processing area corresponding to the adjustment target area, on the processing target surface side of the processing object, with an amount of plasma energy for obtaining the set surface roughness on the surface of the ink layer formed on the processing area.

A printed material manufacturing method is performed by a printing apparatus including a plasma processing unit that performs plasma processing on a processing target surface side of a processing object, and a recording unit that ejects ink to the processing target surface side of the processing object. The printed material manufacturing method includes: acquiring setting information, in which an adjustment target area for adjusting surface roughness and surface roughness of the adjustment target area on a surface of an ink layer formed with the ink are set; and controlling the plasma processing unit to perform plasma processing on a processing area corresponding to the adjustment target area, on the processing target surface side of the processing object, with an amount of plasma energy for obtaining the set surface roughness on the surface of the ink layer formed on the processing area.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 22 is a diagram illustrating an example of a data structure of a first table;

FIG. 23 is a diagram illustrating an example of a data structure of a second table;

DETAILED DESCRIPTION OF THE PREFERRED EMBODIMENTS

Figure 1:
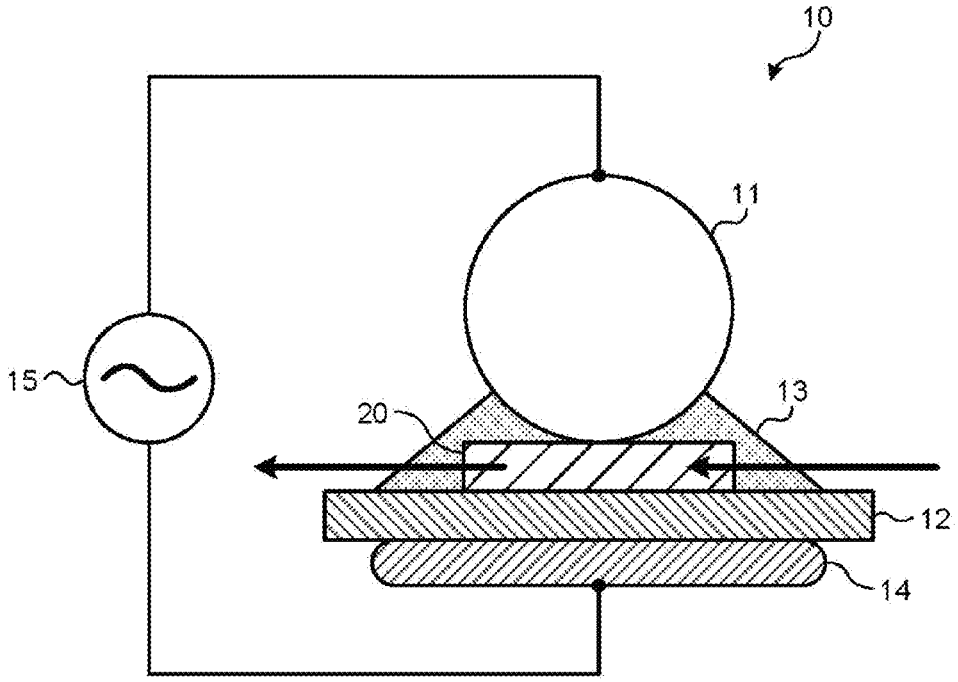
FIG. 1 is a diagram for explaining an outline of plasma processing according to an embodiment.

Exemplary embodiments of a printing apparatus, a printing system, and a printed material manufacturing method will be described in detail below with reference to the accompanying drawings.

First Embodiment

In a first embodiment, plasma processing is performed on a processing target surface side of a processing object.

Processing objects used in the embodiment are, for example, an impermeable recording medium, a slowly permeable recording medium, and a permeable recording medium.

The impermeable recording medium is a recording medium through which droplets, such as ink, do not substantially permeate. The phrase "do not substantially permeate" means that the permeability of droplets after a lapse of one minute is equal to or lower than 5%. Examples of the impermeable recording medium include art paper, synthetic resin, rubber, coated paper, glass, metal, ceramic, and wood. For the purpose of adding a function, a base material, into which a plurality of the above-described materials are combined, may be used. Further, it may be possible to use a medium, such as plain paper provided with the above described impermeable layer (for example, a coated layer).

The slowly permeable recording medium is a recording medium, through which when 10 picoliters (pl) of droplets are dropped on the recording medium, it takes 100 milliseconds (ms) or longer for the entire amount of droplets to permeate, and may be art paper, for example. The permeable recording medium is a recording medium, through which when 10 pl of droplets are dropped on the recording medium, it takes 100 milliseconds (ms) or shorter for the entire amount of droplets to permeate, and may be plain paper or porous paper, for example.

In the embodiment, advantageous effects are obtained especially when the impermeable recording medium or the slowly permeable recording medium is applied as a processing object.

In the following, the processing object may be referred to as recording media or a recording medium.

In the embodiment, to adjust surface roughness of an ink layer formed with ink ejected to a processing area subjected to plasma processing, the plasma processing is performed on the processing area of a processing object with a certain amount of plasma energy according to desired surface roughness.

If the plasma processing is performed on a surface of a processing object, wettability of the surface of the processing object improves. If the wettability of the surface of the processing object improves, a dot landed on the processing object subjected to the plasma processing spreads promptly. Therefore, it becomes possible to promptly dry ink on the surface of the processing object. Consequently, it becomes possible to cause ink pigment to aggregate while preventing dispersion of the pigment. As a result, it becomes possible to prevent occurrence of beading or bleed. Further, it becomes possible to adjust surface roughness of an ink layer by aggregation of the pigment.

Specifically, in the plasma processing, an organic substance on the surface is oxidized by active species, such as oxygen radical, hydroxyl radical (—OH), or ozone, which is generated in plasma, and a hydrophilic functional group is formed.

Therefore, with use of the plasma processing, it is possible to not only control the wettability (hydrophilicity) of the surface of a processing object but also control a pH value (acidification) of the surface of the processing object. Further, with use of the plasma processing, it is possible to control aggregation of pigment contained in an ink layer formed on the processing object subjected to the plasma processing, and adjust surface roughness of the ink layer.

Furthermore, with use of the plasma processing, it is possible to improve circularity of an ink dot (hereinafter, simply referred to as a dot) by controlling permeability, prevent coalescence of dots, and enhance sharpness and color gamut of the dots. Consequently, it becomes possible to solve image defects, such as beading and bleed, and produce a printed material on which a high-quality image is formed. Moreover, an amount of ink droplets can be reduced by making uniform and thinning the thicknesses of aggregation of pigment on a processing object, so that it becomes possible to reduce energy for drying ink and printing costs.

FIG. 1 is a diagram for explaining an outline of the plasma processing employed in the embodiment. As illustrated in FIG. 1, in the plasma processing employed in the embodiment, a plasma processing device 10 is used, which includes a discharge electrode 11, a counter electrode 14, a dielectric 12, and a high-frequency high-voltage power supply 15. The dielectric 12 is disposed between the discharge electrode 11 and the counter electrode 14. The high-frequency high-voltage power supply 15 applies a high-frequency high-voltage pulse voltage between the discharge electrode 11 and the counter electrode 14.

The voltage value of the pulse voltage is about 10 kilovolts (kV) (peak to peak), for example. The frequency of the pulse voltage is about 20 kilohertz (kHz), for example. By supplying the above-described high-frequency high-voltage pulse voltage between the two electrodes, atmospheric pressure non-equilibrium plasma 13 is generated between the discharge electrode 11 and the dielectric 12. A processing object 20 passes between the discharge electrode 11 and the dielectric 12 while the atmospheric pressure non-equilibrium plasma 13 is generated. Therefore, the side facing the discharge electrode 11 (that is, a processing target surface side), of the processing object 20 is subjected to the plasma processing.

In the plasma processing device 10 illustrated in FIG. 1, the rotary discharge electrode 11 and the belt-conveyor type dielectric 12 are employed as one example. The processing object 20 is conveyed while being nipped between the discharge electrode 11 being rotated and the dielectric 12, and passes through the atmospheric pressure non-equilibrium plasma 13. Therefore, the processing target surface side of the processing object 20 comes in contact with the atmospheric pressure non-equilibrium plasma 13 and is subjected to the plasma processing. The atmospheric pressure non-equilibrium plasma 13 is plasma using dielectric barrier discharge.

The plasma processing using the atmospheric pressure non-equilibrium plasma is one of preferable plasma processing methods for the processing object 20 because an electron temperature is extremely high and a gas temperature is close to a room temperature.

To stably generate the atmospheric pressure non-equilibrium plasma in a wide range, it is preferable to perform atmospheric pressure non-equilibrium plasma processing using dielectric barrier discharge in the manner of streamer breakdown. The dielectric barrier discharge in the manner of streamer breakdown may be generated by applying an alternating high voltage between electrodes coated with a dielectric, for example.

As the method of generating the atmospheric pressure non-equilibrium plasma, various methods other than the above-described dielectric barrier discharge in the manner of streamer breakdown may be employed. For example, it may be possible to employ dielectric barrier discharge in which an insulating material such as a dielectric is inserted between electrodes, corona discharge in which a significantly non-uniform electric field is applied to a thin metal wire or the like, and pulse discharge in which a short pulse voltage is applied. Further, two or more of the above methods may be combined. Furthermore, while the plasma processing in the embodiment is performed in the atmosphere, it is not limited thereto. The plasma processing may be performed under a gas atmosphere, such as a nitrogen atmosphere or an oxygen atmosphere.

Moreover, while the discharge electrode 11 that can rotate to feed the processing object 20 in accordance with the conveying direction is employed in the plasma processing device 10 illustrated in FIG. 1, it is not limited thereto. For example, as will be described later, it may be possible to employ one or more discharge electrodes that can move in the vertical direction (scan direction) with respect to the conveying direction of the processing object 20.

The plasma processing used in the embodiment will be described in detail below.

In the plasma processing, the processing object 20 is irradiated with plasma in the atmosphere, so that polymers on the surface of the processing object 20 are made to react and a hydrophilic functional group is generated. Specifically, electrons e released from a discharge electrode are accelerated in an electric field, and excite and ionize atoms and molecules in the atmosphere. The ionized atoms and molecules also release electrons, so that the number of high-energy electrons increases. Therefore, streamer discharge (plasma) is generated. The high-energy electrons generated by the streamer discharge break polymer bonds on the surface of the processing object 20 (for example, coated paper) (a coating layer of the coated paper is immobilized by calcium carbonate and starch as a binder, and the starch has a polymeric structure), and are bonded again with oxygen radical O*, hydroxyl radical (—OH), and ozone $O_3$ in a gas phase. Therefore, polar functional groups, such as hydroxyl groups or carboxyl groups, are formed on the surface of the processing object 20. As a result, hydrophilicity and acidity are given to the surface of the processing object 20. Consequently, the wettability of the surface of the processing object 20 increases, and the surface is acidified (the pH value is reduced).

Acidification in the embodiment means that the pH value of the surface on the processing target surface side of the processing object 20 is reduced to a pH value at which pigment contained in ink aggregates. To reduce the pH value is to increase the density of hydrogen ions $H^+$ in an object. The pigment in the ink before coming into contact with the surface on the processing target surface side of the processing object 20 are negatively charged and dispersed in vehicle.

Figure 2:
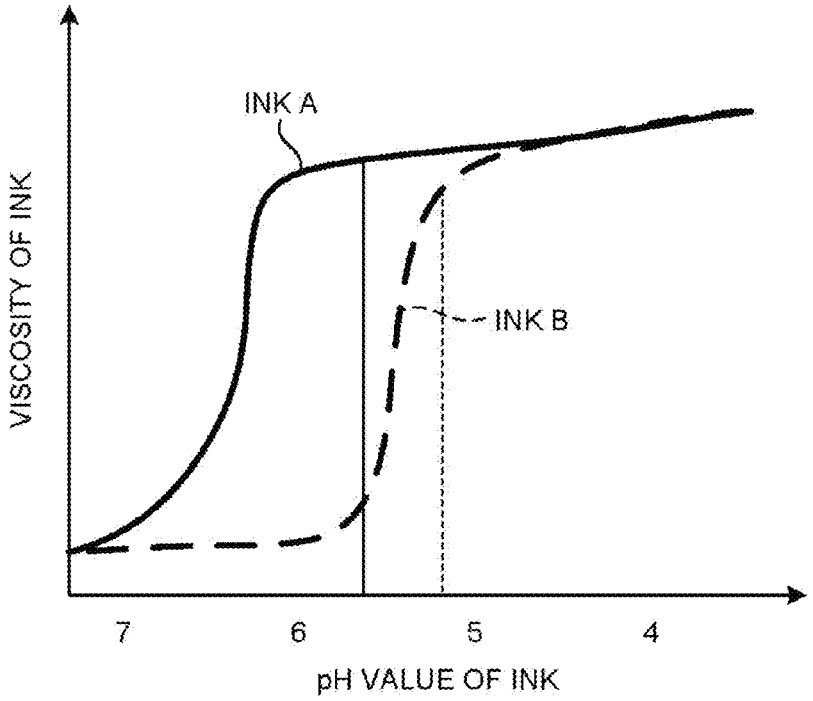
FIG. 2 is a diagram illustrating an example of a relationship between a pH value and viscosity of ink.

FIG. 2 is a diagram illustrating an example of a relationship between the pH value and the viscosity of ink. As illustrated in FIG. 2, the viscosity of ink increases as the pH value thereof decreases. This is because the negatively charged pigment in the vehicle of the ink is electrically neutralized as the acidity of the ink increases, and therefore, the pigment aggregates. Therefore, by reducing the pH value of the surface on the processing target surface side of the processing object 20 such that the pH value of the ink reaches a value corresponding to the necessary viscosity in the graph in FIG. 2, it is possible to increase the viscosity of the ink. This is because, when the ink adheres to the surface on the processing target surface side of the processing object 20, the pigment is electrically neutralized by hydrogen ions $H^+$ on the surface on the processing target surface side and the pigment aggregates. This can prevent mixture between adjacent dots and prevent the pigment from permeating deeply into the processing object 20 (or even to the back surface thereof). To reduce the pH value of the ink to the pH value corresponding to the necessary viscosity, the pH value of the surface on the processing target surface side of the processing object 20 needs to be smaller than the pH value of the ink corresponding to the necessary viscosity.

Further, the pH value for obtaining the necessary viscosity of the ink varies depending on the characteristics of the ink. Specifically, as illustrated in FIG. 2, the pigment in ink A aggregates at a pH value relatively close to the neutrality, thereby increasing the viscosity. In contrast, the pigment in ink B having a different characteristic from that of the ink A aggregates at a pH value smaller than that of the ink A.

The behavior of aggregation of pigment in a dot, the drying speed of the vehicle, and the permeation speed of the vehicle in the processing object 20 vary depending on a droplet amount that varies depending on a dot size (a small droplet, a medium droplet, or a large droplet), a type of the processing object 20, a type of ink, and/or the like. Therefore, in the embodiment described below, the amount of plasma energy in the plasma processing may be controlled at an optimum value depending on the type of the processing object 20, the amount of ink (droplet amount), or the type of ink.

Figure 3:
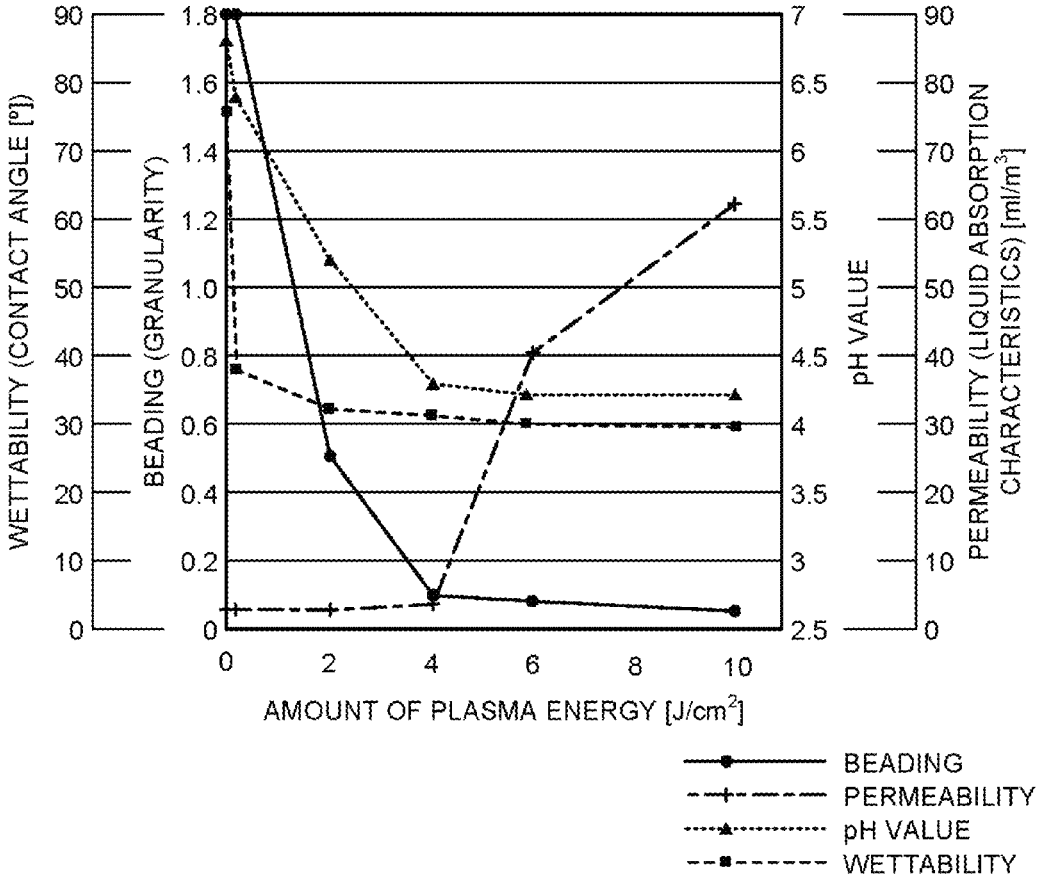
FIG. 3 is a graph of an evaluation result of wettability, beading, a pH value, and permeability of the surface of a processing object with respect to plasma energy.

FIG. 3 is a graph of an evaluation result of wettability, beading, a pH value, and permeability of the surface of a processing object with respect to plasma energy according to the embodiment. FIG. 3 illustrates how surface characteristics (the wettability, the beading, the pH value, and the permeability (liquid absorption characteristics)) change depending on the plasma energy when printing is performed on coated paper serving as the processing object 20. To obtain the evaluation illustrated in FIG. 3, aqueous pigment ink having characteristics, in which pigment aggregates by acid (alkaline ink in which negatively charged pigment is dispersed), was used as the ink.

As illustrated in FIG. 3, the wettability of the surface of the coated paper is sharply improved when the value of the plasma energy is low (for example, about 0.2 J/cm$^2$ or less), but is not much improved even when the plasma energy is increased more than that. In contrast, the pH value of the surface of the coated paper decreases to a certain extent by increasing the plasma energy. However, the pH value is saturated when the plasma energy exceeds a certain value (for example, about 4 J/cm$^2$). The permeability (liquid absorbability) is sharply improved from the point about where the decrease in pH is saturated (for example, about 4 J/cm$^2$). However, this phenomenon varies depending on polymer components included in the ink.

As a result, the value of beading (granularity) is extremely improved when the permeability (liquid absorption characteristics) starts to be improved (for example, about 4 J/cm$^2$). The beading (granularity) is a numerical value indicating roughness of an image and indicates variation in the density with a standard deviation of an average density. In FIG. 3, a plurality of densities in a solid image formed of dots of two or more colors are sampled, and a standard deviation of the densities is indicated as the beading (granularity). As described above, the ink ejected onto the coated paper subjected to the plasma processing according to the embodiment spreads into a perfect circle and permeates while aggregating.

The improvement in the wettability of the surface of the processing object 20 and the acidification (reduction in pH) of the surface of the processing object 20 cause the ink pigment to aggregate, improve the permeability, and cause the vehicle to permeate into the coating layer. This increases the pigment density on the surface of the processing object 20 and makes it possible to prevent movement of the pigment even if dots coalesce with one another. Consequently, it becomes possible to prevent mixture of pigments and enable the pigment to uniformly precipitate and aggregate on the surface of the processing object.

Further, with the improvement in the wettability of the surface of the processing object 20 and the acidification (reduction in pH) of the surface of the processing object 20, the speed of aggregation of the pigment contained in the ink is increased and unevenness of the surface (surface roughness) of the ink layer formed with the ink is adjusted.

However, the effect of adjusting the surface roughness varies depending on the components of the ink (type of the ink) or an ink droplet amount (amount of the ink). For example, if the ink droplet amount corresponds to a small droplet, mixture of pigments caused by coalescence of dots is less likely to occur compared with the case of a large droplet. This is because a smaller amount of vehicle can be dried and permeate more promptly and enables the pigment to aggregate with a small pH reaction. Further, the effect of the plasma processing varies depending on the type of the processing object 20 and the environment (humidity or the like). Therefore, the amount of plasma energy in the plasma processing may be controlled to an optimum value depending on the amount of the ink, the type of the processing object 20, the components of the ink (that is, the type of the ink), and the environment.

Figure 4:
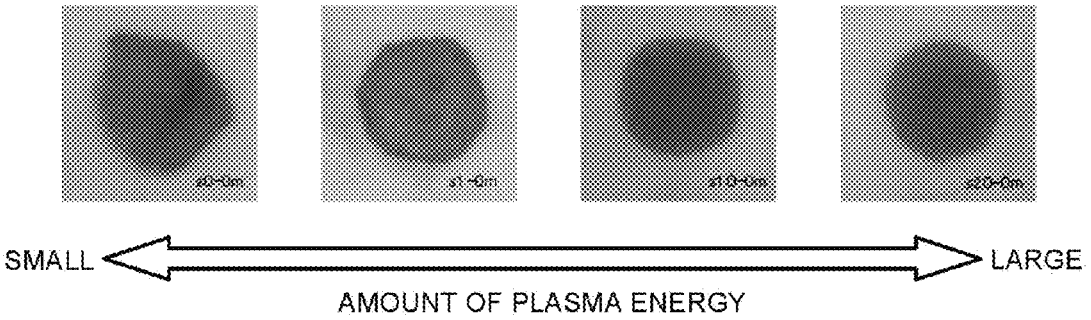
FIG. 4 is a diagram illustrating a result of observation of the amount of plasma energy and the uniformity of aggregation of pigment.

FIG. 4 is a diagram illustrating a result of observation of the amount of plasma energy and the uniformity of aggregation of pigment. The uniformity of aggregation of the pigment improves with an increase in the amount of plasma energy.

Figure 5:
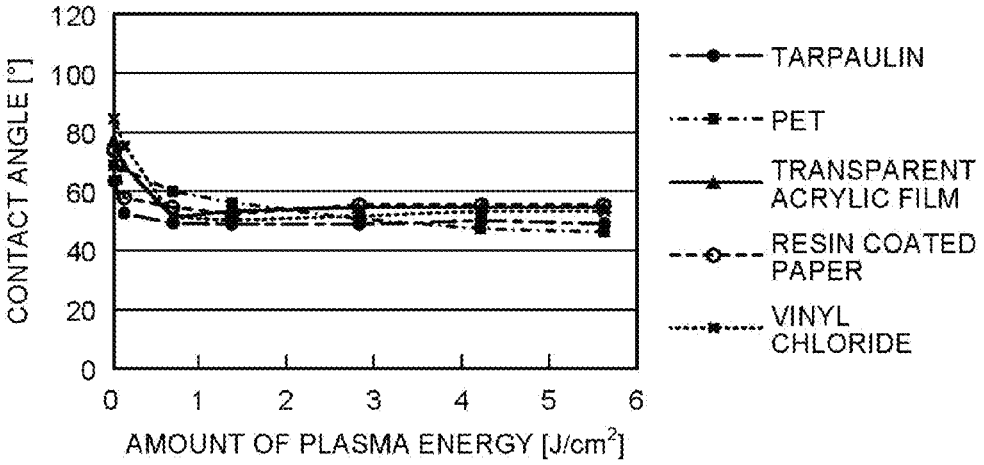
FIG. 5 is a graph illustrating a result of measurement of a contact angle of pure water when an impermeable recording medium is subjected to plasma processing.

FIG. 5 is a graph illustrating a result of measurement of a contact angle of pure water when various impermeable recording media are subjected to the plasma processing. In FIG. 5, the horizontal axis indicates plasma energy. As illustrated in FIG. 5, even in an impermeable recording medium, the wettability is improved through the plasma processing. In the case of aqueous pigment ink, the wettability is further improved because the surface tension is lower than that of pure water. Specifically, the plasma processing causes the aqueous pigment ink to easily and thinly spread out with wetting, so that a surface state advantageous to water evaporation is obtained. In the following, vinyl chloride will be described. However, as indicated in the results described herein, the same effect of the plasma processing is obtained in an impermeable recording medium made of thermoplastic resin, such as polyester or acrylic.

Figure 6:
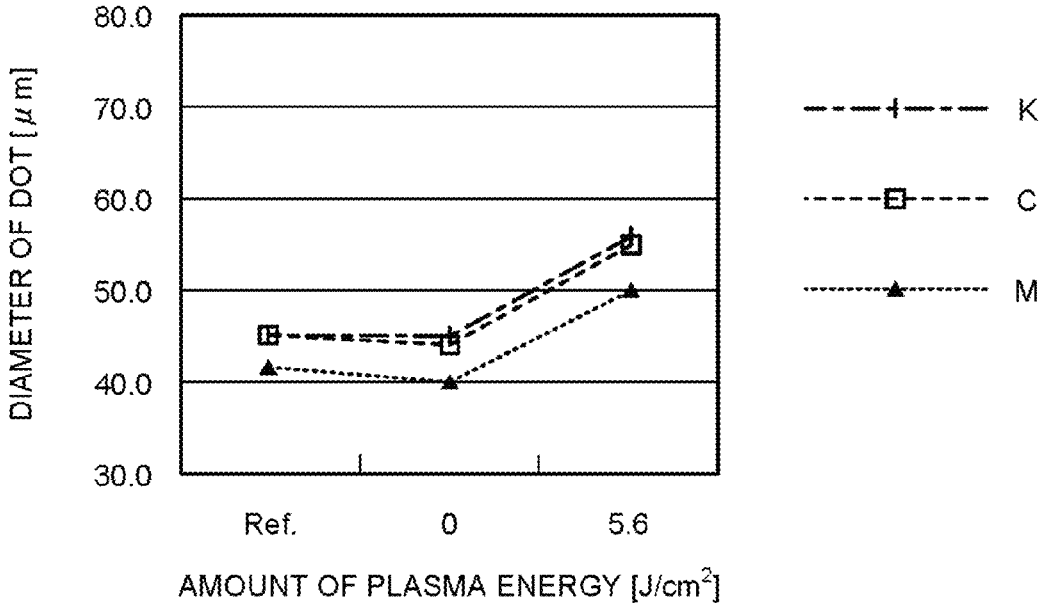
FIG. 6 is a graph illustrating diameters of dots when ink droplets with the same size were dropped on the impermeable recording medium.
Figure 7:
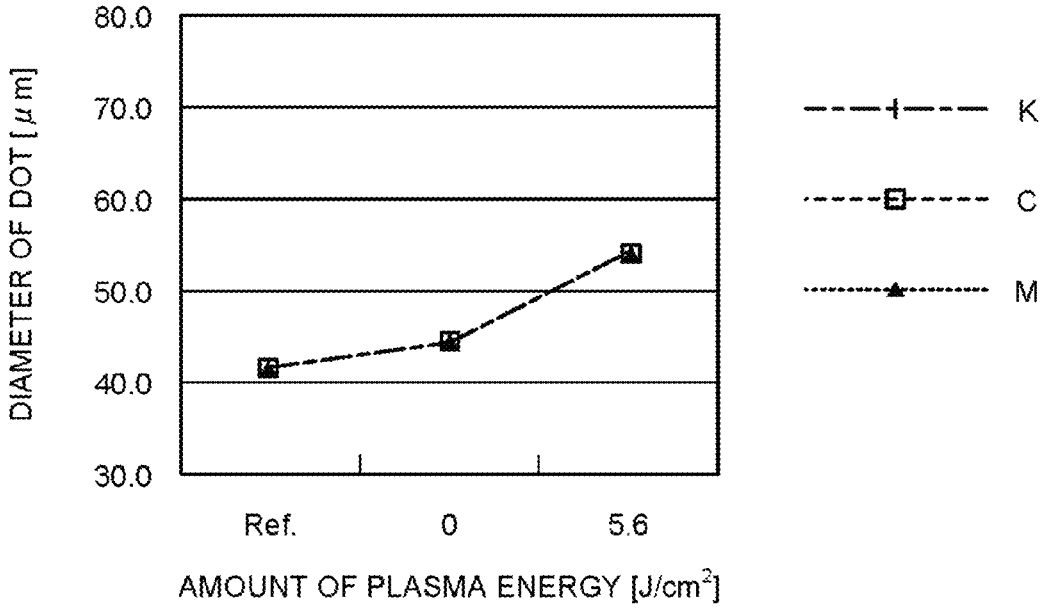
FIG. 7 is a graph illustrating diameters of dots when ink droplets with the same size were dropped on the impermeable recording medium.

FIG. 6 is a graph illustrating diameters of dots when ink droplets with the same size were dropped on the surface of a vinyl chloride sheet that is an impermeable recording medium. FIG. 7 is a graph illustrating diameters of dots when ink droplets with the same size were dropped on the surface of tarpaulin that is an impermeable recording medium. Tarpaulin is a sheet composed of polyester fibers and a synthetic resin sandwiching the polyester fibers.

Ink used in the experiments illustrated in FIGS. 6 and 7 was aqueous pigment ink, which was prepared by mixing about 3 wt % of pigment and about 5 wt % of styrene-acrylic resin having a particle diameter of 100 to 300 nanometers (nm) in a compound liquid of about 50 wt % of ether solvent and diol solvent and a small amount of surface active agents to disperse the pigment, and prepared to have the surface tension of 21 to 24 N/m and the viscosity of 8 to 11 mPa·s.

As illustrated in FIGS. 6 and 7, when the plasma processing was performed (5.6 J/cm$^2$), the diameters of dots were increased by 1.2 to 1.3 times as compared with the case where the plasma processing was not performed (Ref.) and where the number of heaters used to dry the ink was reduced without performing the plasma processing (0 J/cm$^2$). This result means that, when the plasma processing (5.6 J/cm$^2$) was performed, it is possible to promptly dry the ink landed on the surface of the impermeable recording medium, as described above.

Figure 8:
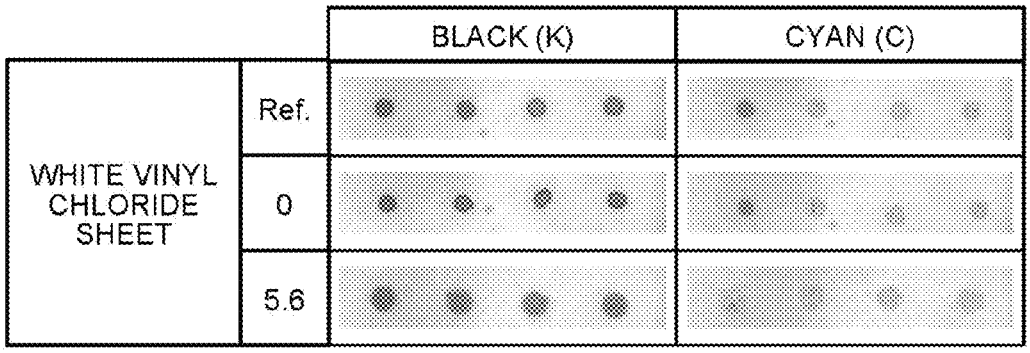
FIG. 8 is an image of ink dots.

FIG. 8 is an image of ink dots actually formed on the surface of the impermeable recording medium (vinyl chloride sheet) when ink droplets with the same size were dropped on the recording medium. In FIG. 8, ink dots of black ink are illustrated at the left, and ink dots of cyan ink are illustrated at the right. Further, in FIG. 8, four dots were formed under each condition. As illustrated in FIG. 8, when the plasma processing (5.6 J/cm$^2$) was performed, the diameters of the dots were increased as compared with the case where the plasma processing was not performed (Ref.) and where the number of heaters used to dry the ink was reduced without performing the plasma processing (0 J/cm$^2$). Further, when the plasma processing (5.6 J/cm$^2$) was performed, the circularity of the dots was improved as compared with the case where the plasma processing was not performed (Ref.) and where the number of heaters used to dry the ink was reduced without performing the plasma processing (0 J/cm$^2$).

Figure 9:
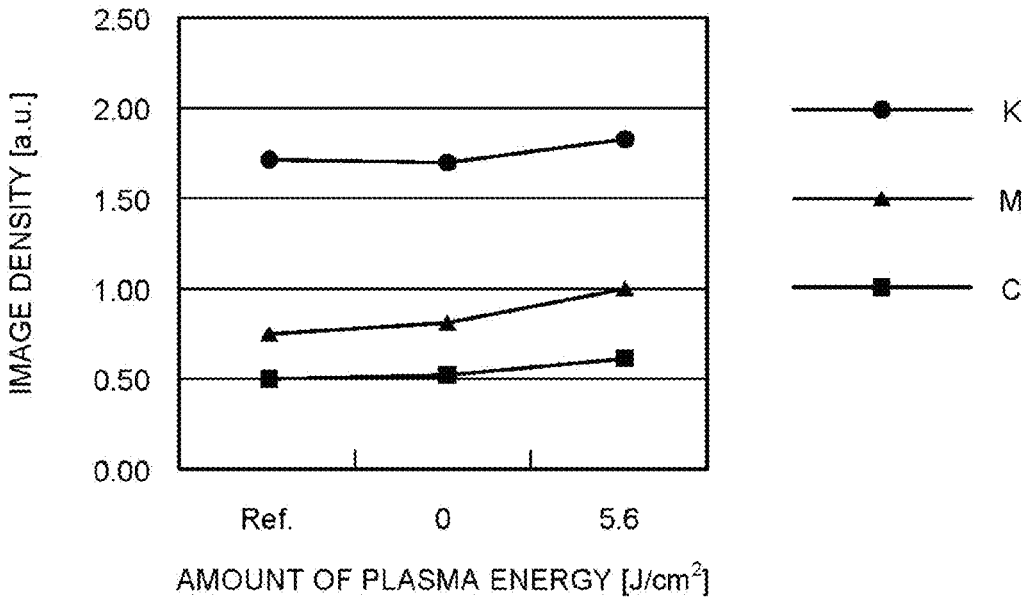
FIG. 9 is a graph illustrating image densities.
Figure 10:
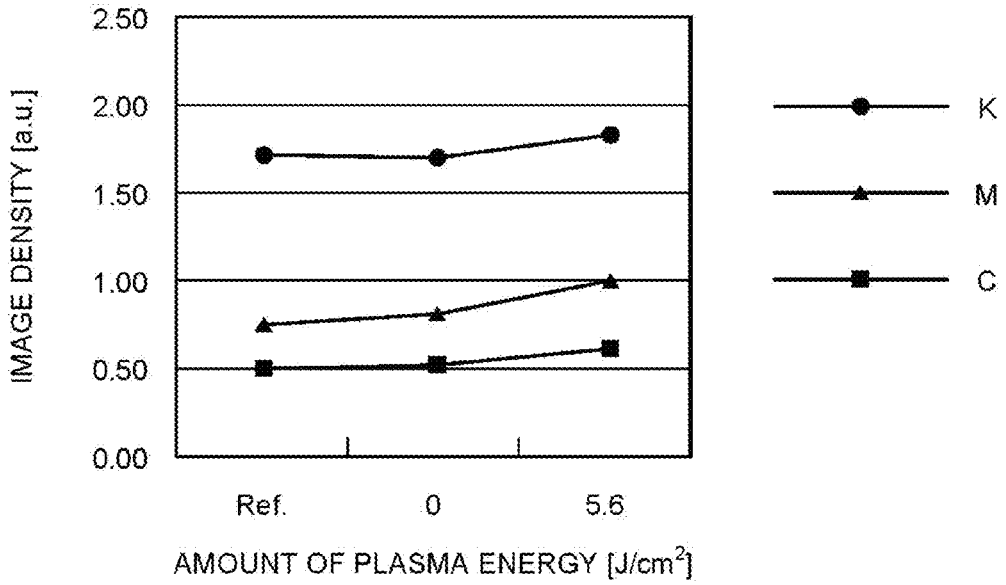
FIG. 10 is a graph illustrating image densities.

FIG. 9 is a graph illustrating image densities obtained when solid printing was performed on the vinyl chloride sheet, which is an impermeable recording medium, under different conditions. FIG. 10 is a graph illustrating image densities obtained when solid printing was performed on the tarpaulin, which is an impermeable recording medium, under different conditions. As illustrated in FIGS. 9 and 10, when the plasma processing (5.6 J/cm$^2$) was performed, the image densities were increased as compared with the case where the plasma processing was not performed (Ref.) and where the number of heaters used to dry the ink was reduced without performing the plasma processing (0 J/cm$^2$). This result means that the plasma processing makes it possible to obtain the same density as that in the case where the plasma processing is not performed even if the ink droplet amount is reduced.

Figure 11:
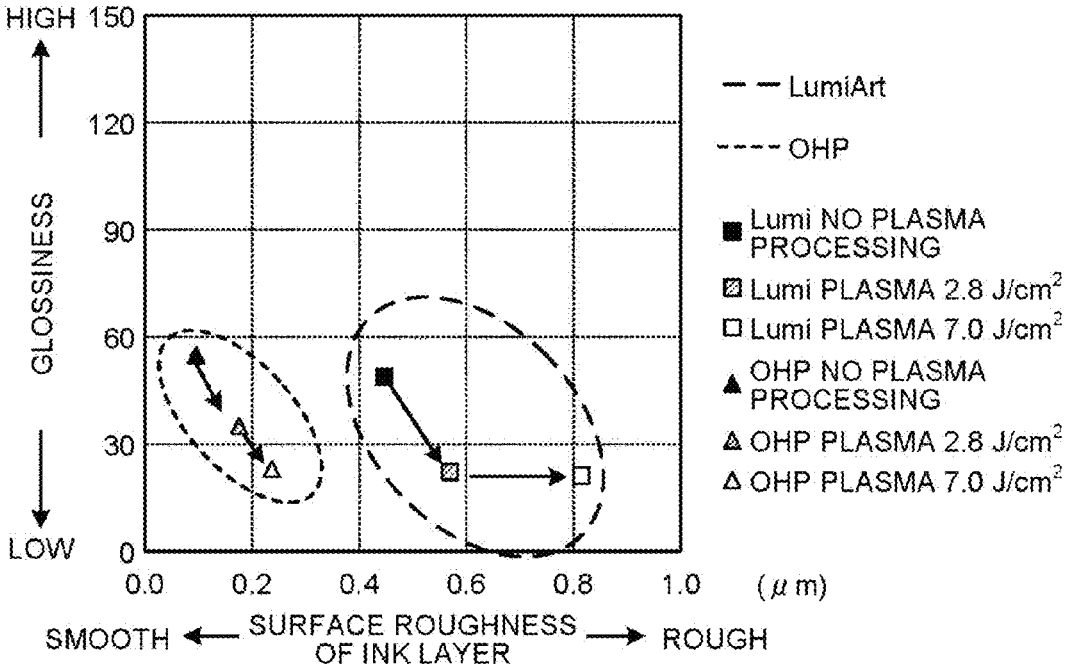
FIG. 11 is a diagram illustrating an evaluation result of surface roughness and glossiness of ink layers.

FIG. 11 is a diagram illustrating an evaluation result of surface roughness and glossiness of ink layers formed on areas subjected to plasma processing when the plasma processing is performed on various types of the processing objects 20.

As illustrated in FIG. 11, when an overhead projector (OHP) sheet was used as the processing object 20, the surface roughness of the ink layer increased and the glossiness decreased with an increase in the amount of the plasma energy applied to the surface of the processing object 20.

In contrast, when LumiArt (registered trademark) was used as the processing object 20, the surface roughness of the ink layer increased and the glossiness decreased with an increase in the amount of the plasma energy applied to the surface of the processing object 20 from the unprocessed state to 2.8 J/cm$^2$. However, when LumiArt (registered trademark) was used as the processing object 20, even if the amount of the plasma energy was increased from 2.79 J/cm$^2$ to 6.97 J/cm$^2$, the glossiness remained approximately the same while the surface roughness increased. The glossiness is approximately the same as the glossiness of the surface of LumiArt (registered trademark). Therefore, it is considered that the glossiness is saturated, where the glossiness of the surface of the processing object 20 is the lower limit.

As described above, by performing the plasma processing on the processing object 20, the surface roughness of the ink layer formed with ink on the processing object 20 increases (smoothness is reduced). This may occur because the improvement in the aggregation of the pigment due to the acidification dominantly acts over the wet spreading of the vehicle due to the hydrophilicity, so that the pigment aggregates before completion of the leveling and the surface roughness on the surface of the ink layer is increased. Further, as illustrated in FIG. 11, the amount of the plasma energy needed to obtain desired surface roughness on the ink layer varies depending on the type of the processing object 20.

As described above, the inventors have found that surface irregularity (surface roughness) of the ink layer can be controlled by performing the plasma processing on the processing target surface side of the processing object 20 and by forming an ink layer by ejecting ink on a processing area subjected to the plasma processing.

Further, the inventors have found that the amount of the plasma energy needed to realize the ink layer with desired surface roughness varies depending on the type of the processing object 20, the amount of the ink amount, and the type of the ink.

Specifically, as indicated in the evaluation result of the glossiness (see FIG. 11), the inventors have found that the surface roughness of the ink layer can be adjusted by adjusting the amount of the plasma energy on the surface of the processing object 20. Further, the inventors have found that the surface irregularity of the ink layer varies depending on the type of the processing object 20. As indicated by the evaluation result, as for the surface irregularity of the ink layer, with an increase in the amount of the plasma energy, the surface roughness on the surface of the ink layer formed with ink ejected on the processing area subjected to the plasm processing is increased (roughened) and the glossiness is decreased due to diffuse reflection of light. Therefore, the inventors have found that it is preferable to reduce the amount of the plasma energy when glossy finish is to be applied to the surface of the ink layer to increase the glossiness (the wettability is improved due to plasma, and the ink layer is dried while it is thinly spread out). Furthermore, the inventors found that the increase in the amount of the plasma energy increases the acidification in an area subjected to the plasma processing, increases the speed of aggregation of the pigment, and enables the ink to be dried in a state where the surface roughness is increased. Therefore, the inventors have found that matte finish is applicable to the surface of the ink layer.

Therefore, in the printing system of the embodiment, the surface of the ink layer formed on the processing target surface side of the processing object 20 is subjected to the plasma processing with the amount of the plasma energy needed to obtain desired surface roughness. Consequently, the ink layer formed on the processing area subjected to the plasma processing is adjusted to have desired surface roughness.

Further, in the printing system of the embodiment, the processing target surface side of the processing object 20 is subjected to the plasma processing with the amount of the plasma energy needed to obtain desired surface roughness depending on the type of the processing object 20, the amount of the ink, or the type of the ink. Therefore, the ink layer formed on the processing area subjected to the plasma processing is adjusted to have the desired surface roughness.

The printing system according to the embodiment will be described in detail below.

Figure 12:
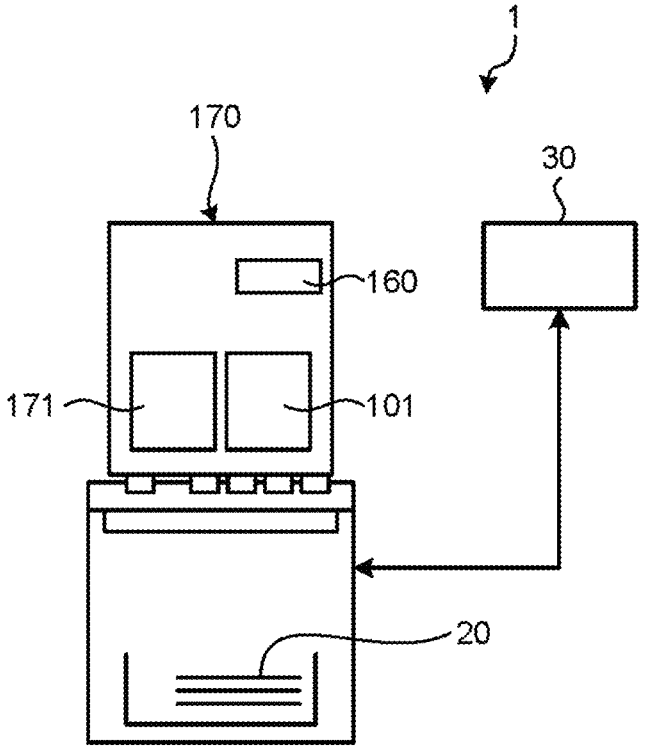
FIG. 12 is a schematic diagram illustrating a schematic configuration of a printing system according to the embodiment.

FIG. 12 is a schematic diagram illustrating a schematic configuration of the printing system according to the embodiment. As illustrated in FIG. 12, a printing system 1 includes an image processing apparatus 30 and a printing apparatus 170. The image processing apparatus 30 and the printing apparatus 170 are connected to each other so as to be able to transmit and receive signals and data. The image processing apparatus 30 and the printing apparatus 170 are connected via a network, such as the Internet or a local area network (LAN).

The image processing apparatus 30 generates print data used by the printing apparatus 170 (details will be described later). The printing apparatus 170 includes a recording unit 171, a plasma processing unit 101, and a control unit 160. The recording unit 171 is an inkjet recording device that forms an ink layer (that is, an image with ink) by ejecting ink droplets from nozzles. The plasma processing unit 101 has the same functions as those of the plasma processing device 10 as described above. The printing apparatus 170 sequentially conveys the processing objects 20 to a conveying path (not illustrated), performs plasma processing, and forms ink layers (images) with ink.

In the embodiment, a case will be described in which the image processing apparatus 30 and the printing apparatus 170 are separated. However, the image processing apparatus 30 may be mounted on the printing apparatus 170 in an integrated manner.

Figure 13:
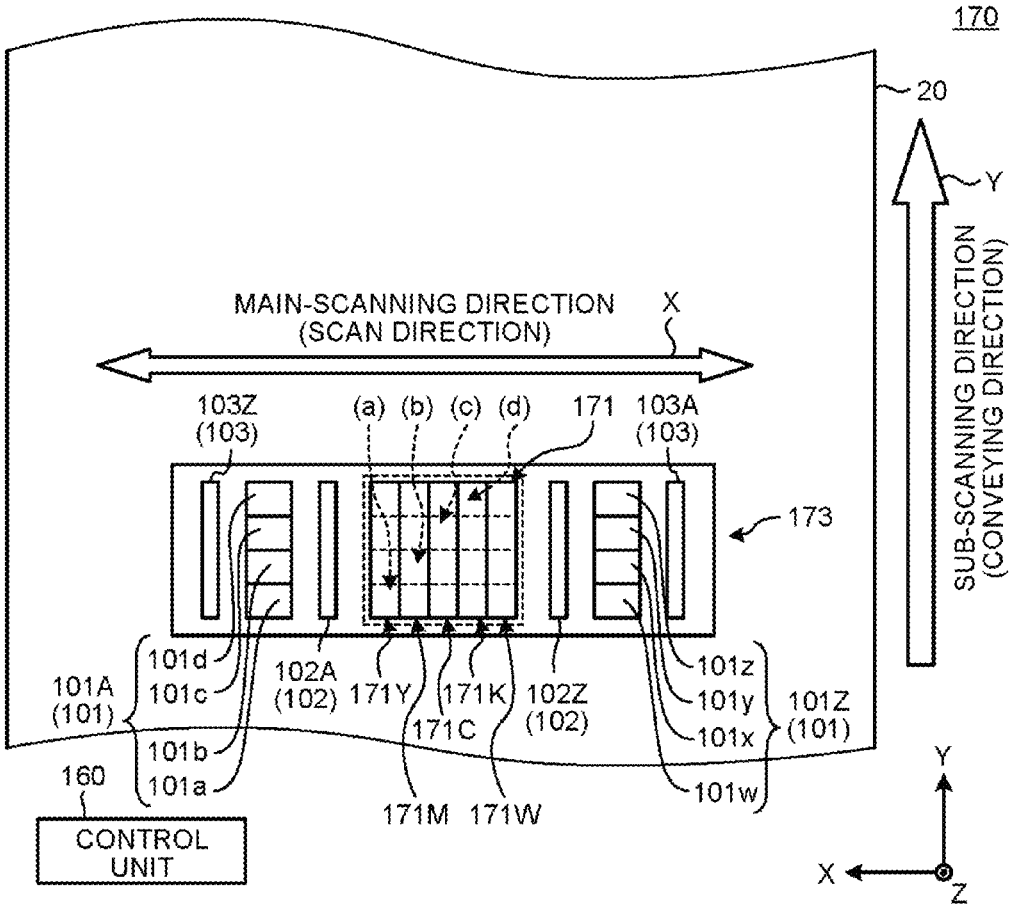
FIG. 13 is a top view illustrating a schematic configuration of a head unit of a printing apparatus.
Figure 14:
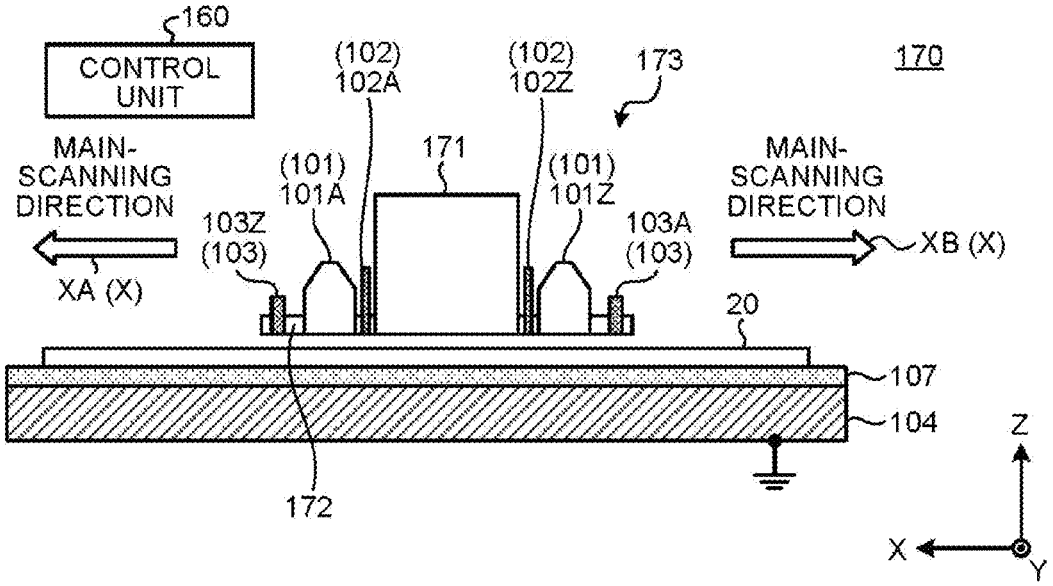
FIG. 14 is a side view illustrating the schematic configuration of the head unit along a scan direction.
Figure 15:
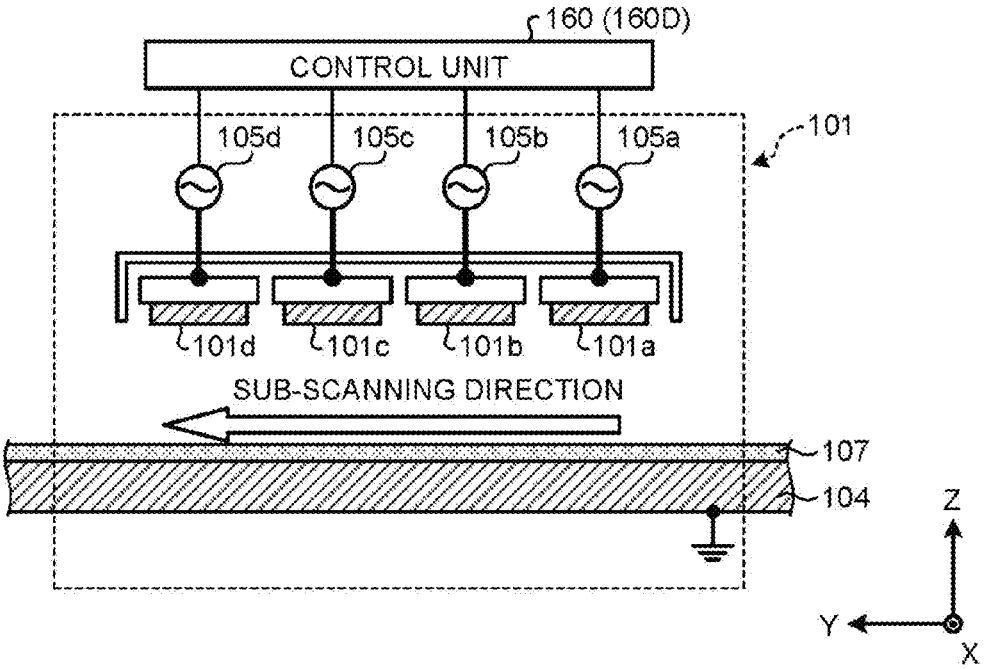
FIG. 15 is a schematic diagram illustrating a schematic configuration of a plasma processing unit mounted on the head unit.

A part of the configuration of the printing apparatus 170 is schematically illustrated in FIGS. 13 to 15.

In the embodiment, as one example, a case will be described in which a multipath method is used as an inkjet recording method of the printing apparatus 170. The inkjet recording method of the printing apparatus 170 is not limited to the multipath method, and may be a single-path method, for example.

FIG. 13 is a top view illustrating a schematic configuration of a head unit 173 of the printing apparatus 170. FIG. 14 is a side view illustrating the schematic configuration of the head unit 173 along a scan direction (a main-scanning direction or a direction of arrow X). FIG. 15 is a schematic diagram illustrating a schematic configuration of the plasma processing unit 101 mounted on the head unit 173.

As illustrated in FIGS. 13 and 14, the printing apparatus 170 includes the control unit 160, the recording unit 171, and the plasma processing unit 101. Further, the printing apparatus 170 includes a heat-drying unit 103 and a detecting unit 102. The detecting unit 102, the heat-drying unit 103, the recording unit 171, and the plasma processing unit 101 are electrically connected to the control unit 160.

The plasma processing unit 101, the detecting unit 102, the heat-drying unit 103, and the recording unit 171 are mounted on a carriage 172 that runs for scanning in the main-scanning direction (in the direction of arrow X in FIGS. 13 to 15). The head unit 173 includes the plasma processing unit 101, the detecting unit 102, the heat-drying unit 103, the recording unit 171, and the carriage 172.

The carriage 172 is moved back and forth in the direction (referred to as the scan direction or the main-scanning direction (see the direction of arrow X)) perpendicular to the conveying direction of the processing object 20 (a sub-scanning direction or a direction of arrow Y) by a driving mechanism (not illustrated). The recording unit 171 ejects ink droplets while being conveyed in the scan direction by the carriage 172, so that an ink layer with the ink is formed on the processing object 20.

The plasma processing unit 101 includes a plurality of discharge electrodes 101*a* to 101*d* and 101*w* to 101*z*. The discharge electrodes 101*a* to 101*d* and 101*w* to 101*z* discharge while being conveyed in the scan direction by the carriage 172, so that the plasma processing is performed on the processing target surface side of the processing object 20 (a side of a surface of the processing object 20 facing the plasma processing unit 101).

The recording unit 171 includes a plurality of ejection heads (for example fives colors×four heads), for example. In the embodiment, a case will be described in which ejection heads (171Y, 171M, 171C, 171K, and 171W) for five colors of black (K), cyan (C), magenta (M), yellow (Y), and white (W) are provided. However, the embodiment is not limited to these ejection heads. Specifically, it may be possible to further include ejection heads corresponding to green (G), red (R), and other colors, or include only an ejection head for black (K). In the following description, K, C, M, Y, and W correspond to black, cyan, magenta, yellow, and white, respectively.

The type of ink ejected by the recording unit 171 is not specifically limited. For example, ink to be used may be a substance obtained by dispersing a pigment (for example, about 3 wt %), a small amount of surface active agents, styrene-acrylic resin (for example, a particle diameter of 100 nm to 300 nm) (for example, about 5 wt %), various additive preservatives, a fungicide, a pH conditioner, a dye dissolution aid, an antioxidant, conductivity conditioner, a surface tension conditioner, or an oxygen absorber in an organic solvent (for example, ether solvent or diol solvent) (for example, about 50 wt %).

It may be possible to use hydrophobic resin, such as acrylic resin, vinyl acetate resin, styrene-butadiene resin, vinyl chloride resin, butadiene resin, and styrene resin, instead of the styrene-acrylic resin. The resin exemplified above preferably has a relatively low molecular weight and is formed in emulsion.

It is preferable to add glycols to the ink in order to effectively prevent nozzle clogging. Examples of glycols include ethylene glycol, diethylene glycol, triethylene glycol, propylene glycol, dipropylene glycol, tripropylene glycol, polyethylene glycol having a molecular weight of 600 or smaller, 1,3-propylene glycol, isopropylene glycol, isobutylene glycol, 1,4-butandiol, 1,3-butandiol, 1,5-pentanediol, 1,6-hexanediol, glycerine, meso-erythritol, and pentaerythritol. Furthermore, examples of glycols include other thiodiglycol, 1,4-butanediol, 1,5-pentanediol, 1,6-hexanediol, propylene glycol, dipropylene glycol, tripropylene glycol, neopentyl glycol, 2-methyl-2,4-pentanediol, trimethylolpropane, trimethylolethane, and mixtures thereof.

Preferable examples of an organic solvent include alkyl alcohols having a carbon number from 1 to 4 such as ethanol, methanol, butanol, propanol, and isopropanol; glycol ether such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-metyl-1-methoxybutanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, dipropylene glycol mono-n-propyl ether, and dipropylene glycol mono-iso-propyl ether; formamide; acetamide; dimethyl sulfoxide; sorbit; sorbitan; acetin; diacetin; triacetin; sulfolane; pyrrolidone; and N-methyl pyrrolidone.

The principal component of the ink may be water. If the organic solvent, monomer, or oligomer is not used for the ink, it is not necessary to select an ink cartridge and a supply path made with a special member. Therefore, it is possible to simplify the structure of the apparatus.

The type of ink is determined according to the mixture ratio of the materials contained in the ink or the types of components contained in the ink.

In the embodiment, a case will be described in which cut paper cut in a predetermined size (for example, A4 or B4) is used as the processing object 20; however, it is not limited thereto. It may be possible to use continuous paper (may be referred to as roll paper).

The type of the processing object 20 is not specifically limited. However, when an impermeable recording medium or a slowly permeable recording medium, such as coated paper, is used as the processing object 20, the effect of the embodiment can be enhanced.

In the example illustrated in FIG. 13, the five ejection heads (171Y, 171M, 171C, 171K, and 171W) for the five colors are arranged along the main-scanning direction. Each of the ejection heads for the different colors includes a plurality of nozzles (not illustrated) arranged along the sub-scanning direction (see the direction of arrow Y in FIGS. 13 to 15). Each of the nozzles ejects ink droplets corresponding to each of pixels of image data.

In the embodiment, the nozzles arranged on each of the ejection heads for the different colors are divided into four groups (hereinafter, referred to as nozzle groups) along the sub-scanning direction (the direction of arrow Y). Therefore, in each line in the main-scanning direction, the nozzle groups for the five colors are arranged. In this case, the recording unit 171 illustrated in FIG. 13 includes nozzle groups (a) to (d). Further, in the following description, a belt-like area on which printing is performed by each of the nozzle groups (a) to (d) with one scan or an image printed on the belt-like area is described as a band.

The nozzles included in each of the nozzle groups (a) to (d) are fixed in a shifted manner so as to correct gaps in order to achieve high speed image forming with high resolution (for example, 1200 dpi). The recording unit 171 copes with a plurality of types of drive frequencies for ink dots (droplets) that are ejected from each of the nozzles, so as to cope with three types of volumes called a large droplet, a medium droplet, and a small droplet. The drive frequencies are input to the recording unit 171 from a drive circuit (not illustrated) connected to the control unit 160.

The discharge electrodes 101*a* to 101*d* and 101*w* to 101*z* of the plasma processing unit 101 are mounted to both sides of the recording unit 171 so as to sandwich the recording unit 171 from the both sides in the scan direction. In FIGS. 13 and 14, the discharge electrodes arranged to one side of the recording unit 171 are referred to as the discharge electrodes 101*a* to 101*d* (they are collectively referred to as a discharge electrode 101A), and the discharge electrodes arranged to the other side are referred to as the discharge electrode 101*w* to 101*z* (they are collectively referred to as a discharge electrode 101Z).

The electrode length of each of the discharge electrodes 101*a* to 101*d* and 101*w* to 101*z* coincides with, for example, the length of each of the nozzle groups (a) to (d) of the recording unit 171 along the sub-scanning direction (hereinafter, referred to as a band width). For example, in a multi-scan head for four scans, the band width is one fourth of the entire length of the recording unit 171 in the sub-scanning direction. In this case, the length of each of the discharge electrodes 101*a* to 101*d* and 101*w* to 101*z* along the sub-scanning direction is also set to one fourth of the entire length of the recording unit 171 in the same manner as the band width.

The electrode length of each of the discharge electrodes 101*a* to 101*d* and 101*w* to 101*z* may be the length of each of the nozzles along the sub-scanning direction, and is not limited to a form that coincides with the band width.

As illustrated in FIG. 15, the plasma processing unit 101 provided with the above described discharge electrodes 101*a* to 101*d* and 101*w* to 101*z* includes high-frequency high-voltage power supplies 105*a* to 105*d* and 105*w* to 105*z* (the illustration of the high-frequency high-voltage power supplies 105*w* to 105*z* is omitted) arranged for the discharge electrodes 101*a* to 101*d* and 101*w* to 101*z*, respectively, includes a dielectric 107 and a counter electrode 104 that are arranged so as to face the whole moving area of the discharge electrodes 101*a* to 101*d* and 101*w* to 101*z*, and includes the control unit 160 that controls the high-frequency high-voltage power supplies 105*a* to 105*d* and 105*w* to 105*z*. The dielectric 107 is disposed between the counter electrode 104 and the discharge electrodes 101*a* to 101*d* and 101*w* to 101*z*, and closer to the counter electrode 104, for example; however, it is not limited thereto. The dielectric 107 may be disposed closer to the discharge electrodes 101*a* to 101*d* and 101*w* to 101*z*. In this case, the dielectric 107 may be divided into a plurality of pieces in accordance with the arrangement of the discharge electrodes 101*a* to 101*d* and 101*w* to 101*z*.

It is preferable that each of the dielectric 107 and the counter electrode 104 illustrated in FIG. 15 has a size that covers the whole moving range of the discharge electrodes 101*a* to 101*d* and 101*w* to 101*z*, for example. A gap through which the processing object 20 can pass is provided between the counter electrode 104 and the discharge electrodes 101*a* to 101*d* and 101*w* to 101*z*. The distance of the gap may be such a distance that the processing object 20 comes in contact with the discharge electrodes 101*a* to 101*d* and 101*w* to 101*z* or such a distance that it does not come in contact with them.

The high-frequency high-voltage power supplies 105*a* to 105*d* and 105*w* to 105*z* supply a pulse voltage of about 10 kV (peak to peak) with a frequency of about 20 kHz between the counter electrode 104 and the discharge electrodes 101*a* to 101*d* and 105*w* to 105*z* under the control of the control unit 160, thereby generating the atmospheric pressure non-equilibrium plasma on the conveying path of the processing object 20. The amount of the plasma energy in this case may be obtained from the voltage value and the application time of the high-frequency high-voltage pulse supplied to each of the discharge electrodes 101*a* to 101*d* and 101*w* to 101*z*, and from the current flowing in the processing object 20, for example.

The control unit 160 can individually turn on or off the high-frequency high-voltage power supplies 105*a* to 105*d* and 105*w* to 105*z*. For example, the control unit 160 may adjust the amount of the plasma energy or an area to be subjected to the plasma processing on the processing object 20 by selectively driving a certain number of the high-frequency high-voltage power supplies 105*a* to 105*d* and 105*w* to 105*z* in proportion to printing speed information input from a higher-level device.

When the necessary amount of the plasma energy varies for each processing area on the processing object 20, the control unit 160 may adjust the amount of the plasma energy by selectively driving a certain number of the high-frequency high-voltage power supplies 105*a* to 105*d* and 105*w* to 105*z* in accordance with the type of the processing object 20. Further, it may be possible to selectively generate plasm with a desired amount of plasma energy in a specific area on the processing object 20 by combining the scanning position of the head unit 173 and on-off control of each of the high-frequency high-voltage power supplies 105*a* to 105*d* and 105*w* to 105*z*.

In the example illustrated in FIG. 13, the nozzle groups (a) to (d) correspond to the respective discharge electrodes 101*a* to 101*d* or the discharge electrodes 101*w* to 101*z* on one-to-one basis. Specifically, plasma processing is performed on a band as a print target area of a certain nozzle group (for example, the nozzle group (a)) by a corresponding discharge electrode (for example, the discharge electrode 101*a* or 101*w*). In this case, plasma processing and printing are performed by one scan, so that it is possible to efficiently perform a printing process.

Further, nozzle groups divided more finely may be employed, and a discharge electrode may be disposed so as to correspond to each of the nozzle groups. Furthermore, a discharge electrode with the width (the length in the direction of arrow Y) corresponding to the width of the nozzle (the width of the nozzle in the sub-scanning direction (the direction of arrow Y)) may be disposed for each of the nozzles arranged in the sub-scanning direction (the direction of arrow Y). In this configuration, it becomes possible to further divide an area to be subjected to the plasma processing by the plasma processing unit 101, and perform the plasma processing with an arbitrary amount of plasma energy for each desired area.

Moreover, as an image forming method using the recording unit 171 with a plurality of the nozzles arranged in the main-scanning direction, an overlap recording method may be employed. The overlap recording method is a recording method in which an image of one main-scanning line is completed by performing printing on the same main-scanning line multiple times by using different nozzles. As the image forming method using the recording unit 171, a multipath method may be employed, in which an image is formed by repeating scanning (scans) in the main-scanning direction by using nozzles corresponding to multiple paths.

Figure 16:
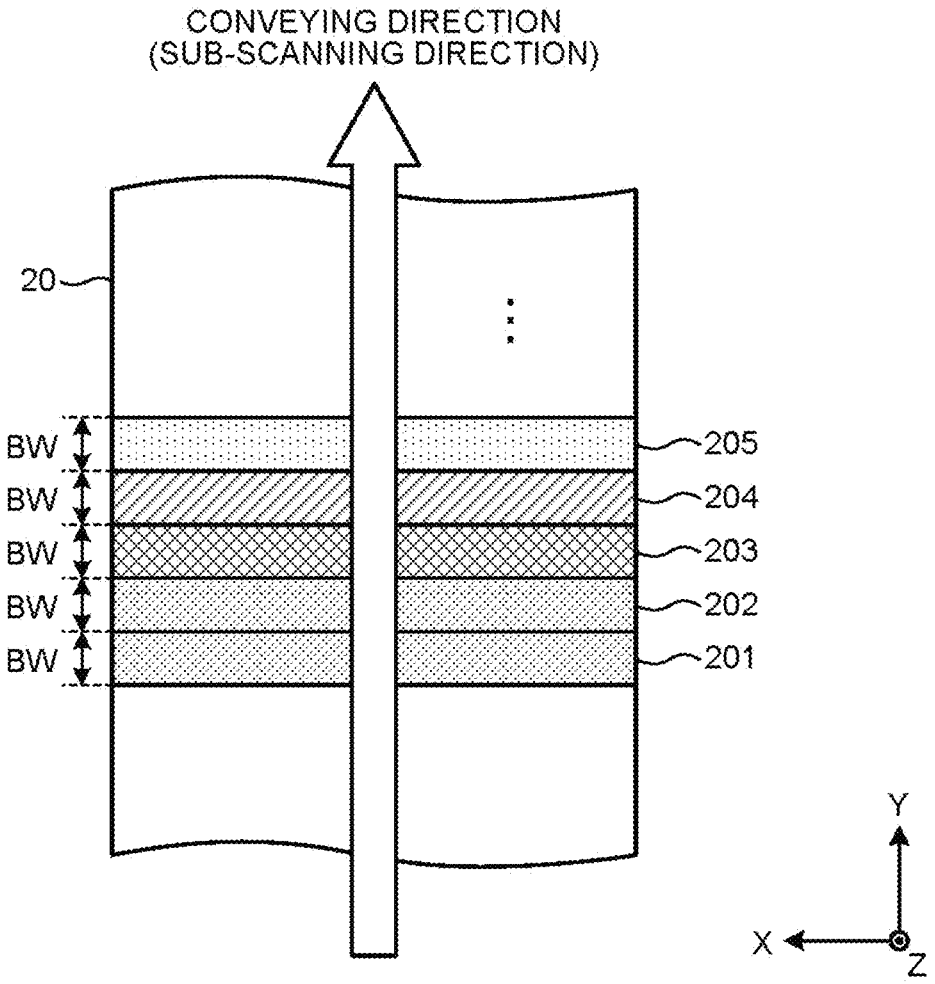
FIG. 16 is a top view illustrating a print state in printing with five scans by a multipath method.
Figure 17:
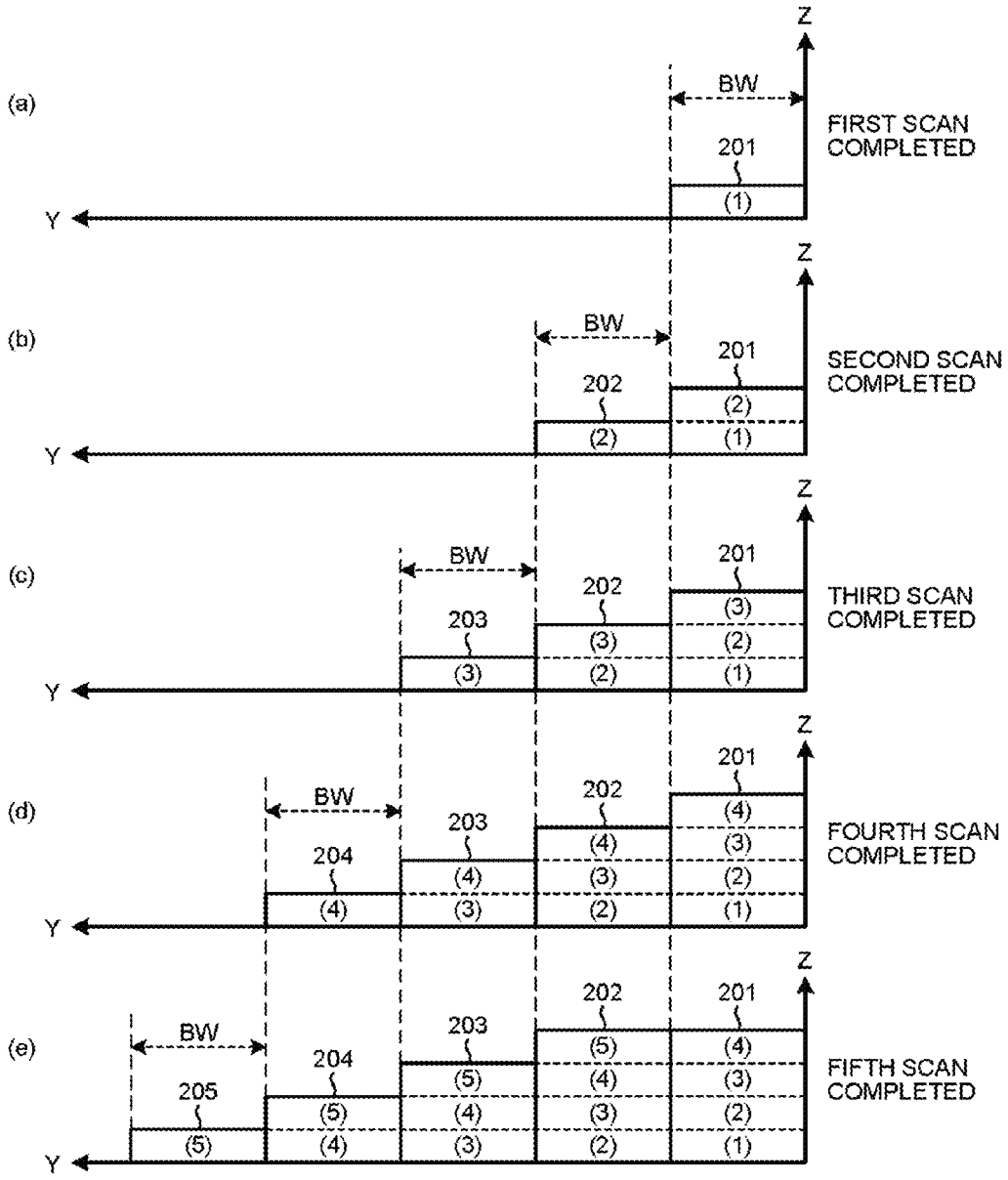
FIG. 17 is a side view illustrating cross-sectional structure of the print state illustrated in FIG. 16.

The image forming method using the multipath method will be described below. FIG. 16 is a top view illustrating a print state in printing with five scans by a multipath method. FIG. 17 is a side view illustrating cross-sectional structure of the print state illustrated in FIG. 16. In the print state illustrated in FIGS. 16 and 17, the number of paths in the sub-scanning direction is set to four, for simplicity of explanation.

The nozzle groups (not illustrated) of the recording unit 171 are divided into four path rows, that is, a first path row to a fourth path row (the nozzle groups (a) to (d)), for example. The nozzles arranged in each of the path rows are used to print a corresponding path. A print area formed by one scan is a belt-like band with a band width BW. From the first scan to the third scan, the nozzle groups are sequentially made to start operation from the nozzle group corresponding to the first path row in accordance with a printing start position in the sub-scanning direction. From the fourth scan to the $(N-3)^{th}$ scan (the $N^{th}$ scan is the last scan), all of the four path rows are printed by one scan. Therefore, from the fourth scan to the $(N-3)^{th}$ scan, printing of four paths is performed by one scan. From the $(N-2)^{th}$ scan to the $N^{th}$ scan, the nozzle groups are sequentially made to stop operation from the nozzle group corresponding to the first path row in accordance with a printing stop position in the sub-scanning direction, in an opposite manner as that from the first scan to the third scan. On the band subjected to four scans, a complete image is formed.

Specifically, as illustrated in FIGS. 16 and 17, upon completion of the first scan, an image (1) is formed by the first scan on a band 201 that corresponds to the printing start position in the sub-scanning direction. Subsequently, with the movement of the recording unit 171 or the processing object 20 in the sub-scanning direction, a scan position of the recording unit 171 is moved in the sub-scanning direction by the band width BW with respect to the processing object 20, and images (2) are formed on the band 201 and a band 202 by the second scan. Thereafter, the scan position of the recording unit 171 is moved in the sub-scanning direction by the band width BW with respect to the processing object 20 by each scan, and images (3) and subsequent images are overlapped on each band. Then, four images are overlapped by four scans, and an image of each band is completed. For example, as illustrated in FIGS. 16 and 17, upon completion of the fifth scan, images of the bands 201 and 202 are completed.

Referring back to FIGS. 13 and 14, the heat-drying unit 103 dries the ink ejected by the recording unit 171. In the embodiment, a case will be described in which the heat-drying unit 103 is a heating device that applies heat. However, it is sufficient that the heat-drying unit 103 is a device that dries or cures an ink layer, and may be appropriately adjusted depending on the type of the ink.

In the embodiment, the heat-drying unit 103 is arranged so as to sandwich the recording unit 171 and the detecting unit 102 from both sides in the main-scanning direction (the direction of arrow X). The heat-drying unit 103 includes a heat-drying unit 103Z arranged on a side adjacent to the plasma processing unit 101A of the recording unit 171, and a heat-drying unit 103A arranged on a side adjacent to the plasma processing unit 1012 of the recording unit 171.

The detecting unit 102 detects a plasma processing state subjected to the plasma processing by the plasma processing unit 101. As the detecting unit 102, a known pH meter for solid substances is used, for example. The detecting unit 102 is not limited to the pH meter, and a known measuring device capable of detecting the plasma processing state is applicable. Further, the head unit 173 may not include the detecting unit 102. In the embodiment, the detecting unit 102 is arranged so as to sandwich the recording unit 171, the detecting unit 102, and the plasma processing unit 101 from both sides in the scan direction (the direction of arrow X).

Therefore, when the head unit 173 performs scanning toward one side (for example, in a direction of arrow XA, see FIG. 14) in the main-scanning direction (the direction of arrow X), a detecting unit 102A detects an area subjected to the plasma processing by the plasma processing unit 101A, and the recording unit 171 ejects ink droplets. Further, when the head unit 173 performs scanning toward the other end (for example, in a direction of arrow XB, see FIG. 14) in the main-scanning direction (the direction of arrow X), a detecting unit 102Z detects an area subjected to the plasma processing by the plasma processing unit 1012, and the recording unit 171 ejects ink droplets.

To form a plurality of ink layers in an overlapping manner, the control unit 160 causes the head unit 173 (the recording unit 171, the plasma processing unit 101, and the heat-drying unit 103) to repeat a series of scanning including ejection of ink droplets for one layer and heating by the heat-drying unit 103, the same number of times as the number of ink layers.

In this case, the control unit 160 may control printing by changing an ink ejection area of each of the ejection heads (171Y, 171M, 171C, 171K, and 171W) for the different colors. For example, it is assumed that a printed material is obtained by laminating a white ink layer with white ink and a color ink layer with color ink (CMYK) in this order on the processing object 20.

In this case, the control unit 160 causes the nozzle groups (a) and (b) of the ejection head 171W, which are on the upstream side in the sub-scanning direction (the direction of arrow Y) for ejecting white ink, to eject white ink droplets, and causes the nozzle groups (c) and (d) of the ejection heads (171Y, 171M, 171C, and 171K), which are on the downstream side in the sub-scanning direction (the direction of arrow Y) for ejecting color ink, to eject CMYK ink droplets. In this case, the control unit 160 also controls drive of the head unit 173 in the main-scanning direction. Therefore, the color ink layer is laminated on the white ink layer.

Further, it is assumed that a printed material is obtained by laminating a color ink layer and a white ink layer in this order on the processing object 20.

In this case, the control unit 160 causes the nozzle groups (c) and (d) of the ejection head 171W, which are on the downstream side in the sub-scanning direction (the direction of arrow Y) for ejecting white ink, to eject white ink droplets, and causes the nozzle groups (a) and (b) of the ejection heads (171Y, 171M, 171C, and 171K), which are on the upstream side in the sub-scanning direction (the direction of arrow Y) for ejecting color ink, to eject CMYK ink droplets. In this case, the control unit 160 also controls drive of the head unit 173 in the main-scanning direction and conveyance of the processing object 20 in the sub-scanning direction for each band width. Therefore, the white ink layer is laminated on the color ink layer.

Furthermore, it is assumed that a printed material is obtained by laminating a color ink layer, a white ink layer, and a color ink layer in this order on the processing object 20.

In this case, the control unit 160 controls, for each color, nozzle groups for ejecting ink with each scan in the main-scanning direction (the direction of arrow X), with respect to each nozzle group that is obtained by dividing the nozzles of the multiple colors in the recording head 171 into three groups in the sub-scanning direction (the direction of arrow Y). Consequently, a printed material with three ink layers is obtained.

Incidentally, there are multiple printing methods as a method of obtaining a printed material by forming ink layers on the processing object 20.

Figure 18:
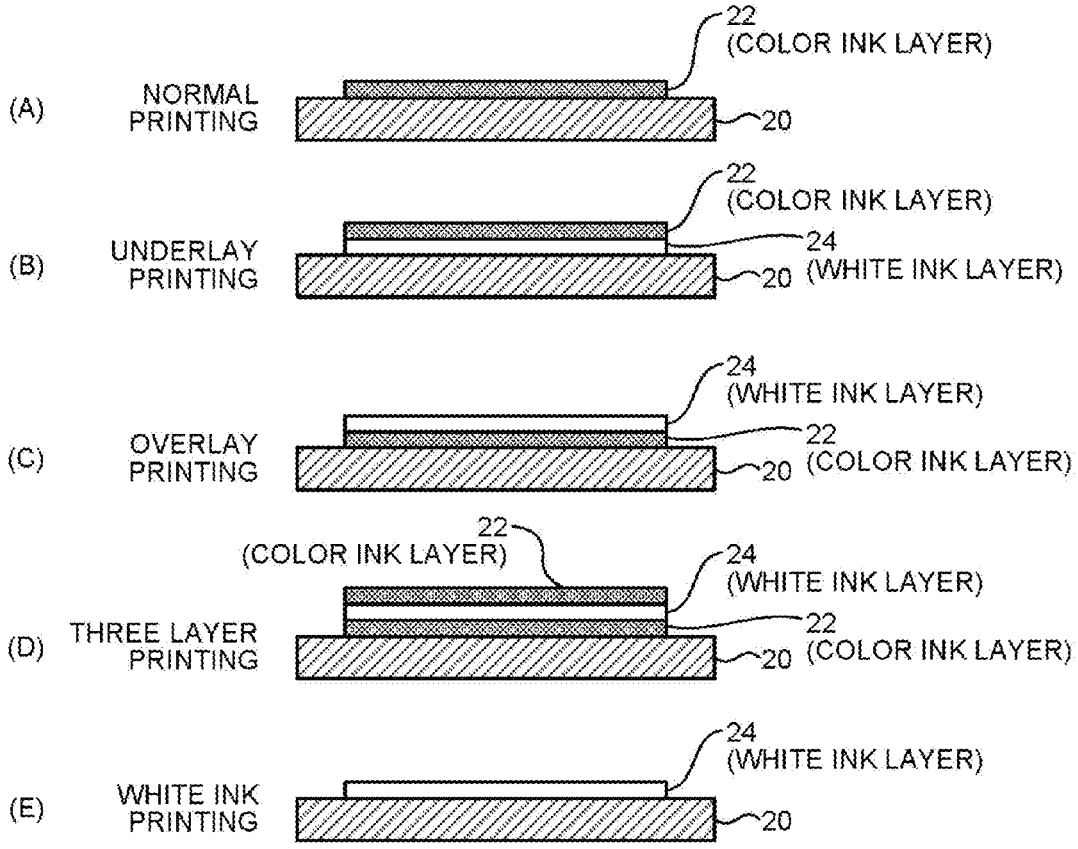
FIG. 18 is a diagram for explaining types of a printing method.

FIG. 18 is a diagram for explaining types of the printing method.

As illustrated in FIG. 18, examples of the printing method include normal printing, underlay printing, overlay printing, three layer printing, and white ink printing.

For example, it is assumed that a transparent medium is used as the processing object 20.

FIG. 18 illustrates normal printing at (a). FIG. 18 illustrates underlay printing at (b). FIG. 18 illustrates overlay printing at (c). FIG. 18 illustrates three layer printing at (d). FIG. 18 illustrates white ink printing at (e).

As illustrated at (a) in FIG. 18, the normal printing is a method to form a color ink layer 22 with color ink on the processing object 20. As illustrated at (b) in FIG. 18, the underlay printing is a printing method to laminate a white ink layer 24 with white ink and the color ink layer 22 with color ink in this order on the processing object 20 when a transparent medium is used as the processing object 20.

As illustrated at (c) in FIG. 18, the overlay printing is a printing method to form the color ink layer 22 of a color image subjected to a mirroring process (symmetrical process) on the transparent processing object 20, and further form the white ink layer 24 with white ink. The overlay printing is a printing method to enable the color ink layer 22 to be viewed from the transparent processing object 20 side, where the transparent processing object 20 provides surface glossiness and protects the color ink layer 22.

As illustrated at (d) in FIG. 18, the three layer printing is a printing method to laminate the color ink layer 22, the white ink layer 24, and the color ink layer 22 in this order on the transparent processing object 20. The three layer printing is used when a printed material is attached to a transparent material based on the assumption that the printed material is to be viewed from both sides of the processing object 20.

As illustrated at (e) in FIG. 18, the white ink printing is a printing method to form the white ink layer 24 with white ink on the processing object 20.

Conventionally, in some cases, there is a need to apply glossy finish with the increased glossiness or matte finish with a delustering effect by providing a specific area of the ink layer formed on the processing object 20 with certain surface roughness that is different from surface roughness on other areas. However, conventionally, to adjust the surface roughness of a specific area on the surface of the ink layer or to adjust the surface of the ink layer to have multiple different types of surface roughness, it is necessary to separately apply transparent toner or the like and it is difficult to perform adjustment easily.

Further, in the case where a printed material is the transparent processing object 20 on which an ink layer is formed, a light source is disposed on a side adjacent to one surface of the printed material such that the printed material can be viewed from a side adjacent to the other surface. Examples of this case include a case where the printed material is used for an electric sign board. If the printed material is used for an electric sign board, ejection unevenness of ink ejected on the processing object 20 is intensified by light, and may be visually recognized as density unevenness.

In this case, for example, it is necessary to reduce density unevenness, which may be visually recognized, by adjusting surface roughness that may cause light scattering on the surface of an ink layer such as a white ink layer.

Therefore, the printing apparatus 170 of the embodiment controls the plasma processing unit 101 to perform plasma processing on a processing area corresponding to an adjustment target area for adjusting surface roughness of an ink layer on the processing target surface side of the processing object 20, with the amount of plasma energy for obtaining set surface roughness on the surface of the ink layer formed on the processing area.

The image processing apparatus 30 generates print data containing setting information, in which an adjustment target area for adjusting surface roughness and surface roughness of the adjustment target area on the surface of the ink layer are set. The printing apparatus 170 adjusts the amount of plasma energy for obtaining the surface roughness contained in the setting information in accordance with the setting information contained in the print data.

The image processing apparatus 30 will be described below.

Figure 19:
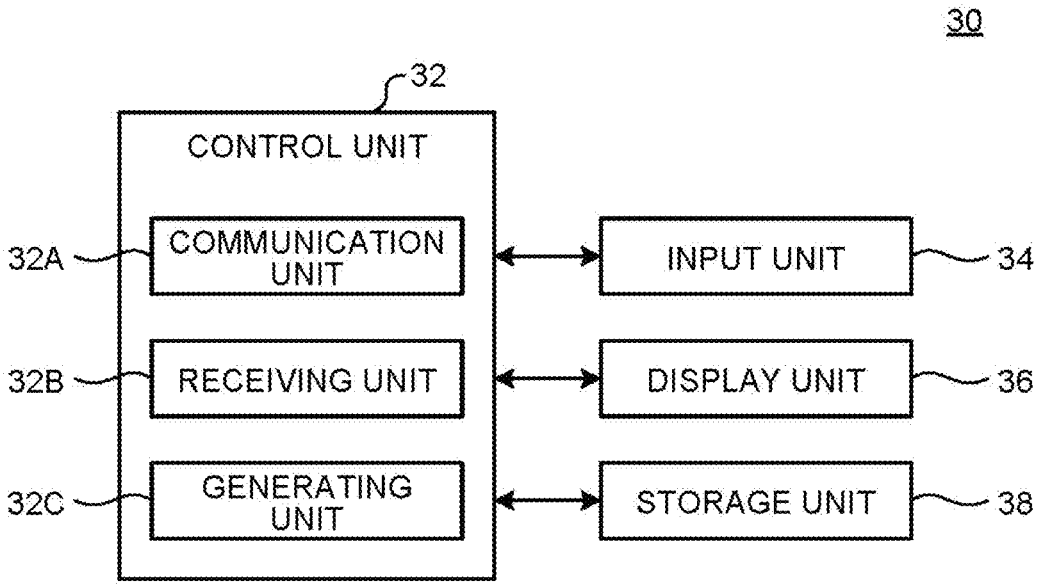
FIG. 19 is a block diagram of an image processing apparatus.

FIG. 19 is a block diagram of the image processing apparatus 30.

The image processing apparatus 30 includes a control unit 32, an input unit 34, a display unit 36, and a storage unit 38. The control unit 32, the input unit 34, the display unit 36, and the storage unit 38 are connected to one another so as to be able to transmit and receive data. The input unit 34 receives an operation instruction from a user. The input unit 34 is, for example, a keyboard, a mouse, a microphone, or the like. The display unit 36 is a known display device that displays various images. A touch panel in which the input unit 34 and the display unit 36 are integrated may be employed. The storage unit 38 stores therein various kinds of data.

The control unit 32 controls the entire image processing apparatus 30. The control unit 32 includes a communication unit 32A, a receiving unit 32B, and a generating unit 32C. A part or all of the communication unit 32A, the receiving unit 32B, and the generating unit 32C may be realized by causing a processing device, such as a central processing unit (CPU), to execute a program, that is, by software, may be realized by hardware, such as an integrated circuit (IC), or may be realized by a combination of software and hardware, for example.

The communication unit 32A communicates with external apparatuses (not illustrated) and the printing apparatus 170. The receiving unit 32B receives image data of an image formed with ink from an external apparatus or the like.

The receiving unit 32B also receives input of setting information from the input unit 34. The setting information is data containing an adjustment target area for adjusting surface roughness and surface roughness of the adjustment target area on the surface of an ink layer formed on the processing target surface side of the processing object 20.

In the embodiment, a case will be described in which the setting information contains the intensity of surface roughness of the adjustment target area as the surface roughness of the adjustment target area. Further, as one example, the setting information indicates three types of intensities of "high intensity", "normal intensity", and "low intensity" as the intensities of the surface roughness of the adjustment target area. The intensities of the surface roughness are not limited to the three intensities as described above, and may be four or more intensities indicating subdivided intensities of the surface roughness. Furthermore, the setting information may contain a value of the surface roughness of the adjustment target area.

For example, the receiving unit 32B displays an input screen for inputting an adjustment target area for adjusting surface roughness and the intensity of the surface roughness on the display unit 36.

Figure 20:
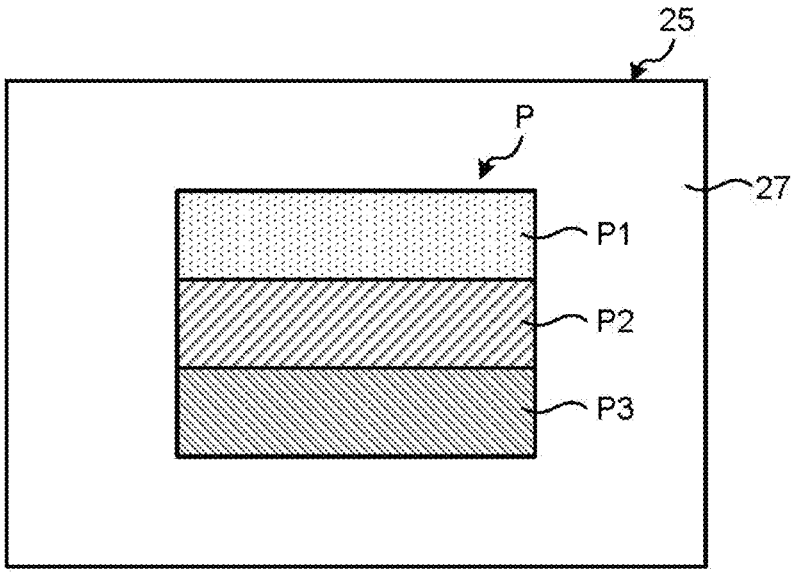
FIG. 20 is a diagram illustrating an example of an input screen.

FIG. 20 is a diagram illustrating an example of an input screen 25. For example, the receiving unit 32B displays, on the input screen 25, an image 27 of the received image data, and character information for requesting input of an adjustment target area and the intensity of surface roughness. A user sets an adjustment target area P for adjusting surface roughness on the image 27 (ink layer) by operating the input unit 34. The user may set a single or a plurality of adjustment target areas P.

For example, it is assumed that a user sets adjustment target areas P1 to P3 for adjusting surface roughness by operating the input unit 34. The user also inputs desired surface roughness for each of the adjustment target areas P1 to P3. In the embodiment, as one example, a case will be described in which the intensity of the surface roughness is input by setting the intensity of the surface roughness ("high intensity", "normal intensity", or "low intensity") in each of the adjustment target areas P1 to P3, as described above.

In the embodiment, the intensity of the surface roughness indicates a rate of the intensity of the surface roughness with respect to reference energy to be described later. In the example illustrated in FIG. 20, the user sets higher (stronger) surface roughness in the adjustment target area P1, the adjustment target area P2, and the adjustment target area P3 in this order (P1<P2<P3).

The user may input a value of desired surface roughness by the input unit 34, instead of the intensity of the surface roughness. Further, the user may set an arbitrary position, range, shape of the adjustment target area P by providing operation instructions through the input unit 34. Furthermore, the user may set a different intensity of the surface roughness in each of the adjustment target areas.

Referring back to FIG. 19, the receiving unit 32B receives, from the input unit 34, the setting information containing an adjustment target area for adjusting surface roughness and surface roughness of the adjustment target area (in the embodiment, the intensity of the surface roughness), which are set by the user. For example, the receiving unit 32B receives setting information, in which the adjustment target area set by the user is indicated in units of objects each representing an adjustment target area and in which the intensity of the surface roughness of the adjustment target area is indicated by a pixel value (for example, a density value).

The generating unit 32C generates print data containing the setting information and image data.

Specifically, the generating unit 32C converts image data received by the receiving unit 32B to a data format that can be processed by the printing apparatus 170. For example, the generating unit 32C performs a conversion process of converting vector data to raster data, a color conversion process of converting colors to CMYKW, or gamma correction, thereby converting the received image data to a data format that can be processed by the printing apparatus 170.

Further, the generating unit 32C converts the surface roughness of each of the adjustment target areas (in the embodiment, the intensity of the surface roughness), which is set in the setting information received by the receiving unit 32B, to setting information that is set in units of pixels. Specifically, setting information in the raster format is generated by setting a pixel value indicating the set surface roughness (in the embodiment, the intensity of the surface roughness) as a pixel value of each of pixels of the adjustment target area represented in the vector format. Each of the pixel positions in the setting information in the raster format corresponds to each of the pixel positions in the image data in the raster format.

The generating unit 32C generates print data containing the image data converted to the raster format and the setting information converted to the raster format. The communication unit 32A outputs the generated print data to the printing apparatus 170. The data format is not limited to these formats.

Figure 21:
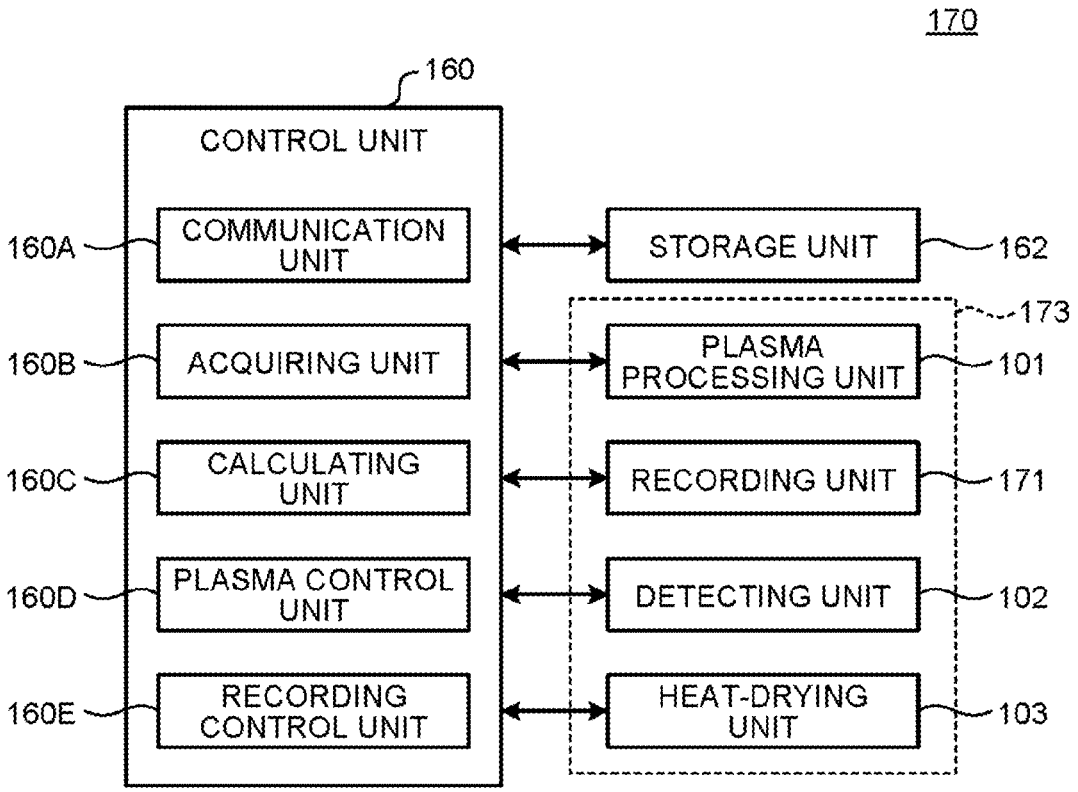
FIG. 21 is a functional block diagram of the printing apparatus.

FIG. 21 is a functional block diagram of the printing apparatus 170.

The printing apparatus 170 includes the control unit 160, a storage unit 162, the plasma processing unit 101, the recording unit 171, the detecting unit 102, and the heat-drying unit 103. The control unit 160, the storage unit 162, the plasma processing unit 101, the recording unit 171, the detecting unit 102, and the heat-drying unit 103 are connected to one another so as to be able to transmit and receive data and signals. As described above, the plasma processing unit 101, the recording unit 171, the detecting unit 102, and the heat-drying unit 103 form the head unit 173. The storage unit 162 stores therein various kinds of data.

The control unit 160 is a computer including a CPU and the like, and controls the entire printing apparatus 170. The control unit 160 may be configured by a circuit other than the CPU.

The control unit 160 includes a communication unit 160A, an acquiring unit 160B, a calculating unit 160C, a plasma control unit 160D, and a recording control unit 160E. A part or all of the communication unit 160A, the acquiring unit 160B, the calculating unit 160C, the plasma control unit 160D, and the recording control unit 160E may be realized by causing a processing device, such as a CPU, to execute a program, that is, by software, may be realized by hardware, such as an IC, or may be realized by a combination of software and hardware, for example.

The communication unit 160A communicates with the image processing apparatus 30 and external apparatuses (not illustrated). In the embodiment, the communication unit 160A receives print data from the image processing apparatus 30.

The acquiring unit 160B acquires setting information contained in the received print data. Specifically, the acquiring unit 160B acquires setting information, in which an adjustment target area for adjusting surface roughness and surface roughness (the intensity of the surface roughness) of the adjustment target area on the surface of an ink layer formed with ink are set. If a plurality of adjustment target areas are set, the acquiring unit 160B acquires setting information, in which the adjustment target areas and surface roughness of each of the adjustment target areas on the surface of the ink layer are set.

The calculating unit 160C calculates the amount of plasma energy for obtaining the set surface roughness on the surface of the ink layer formed on the processing area corresponding to the adjustment target area set in the setting information, on the processing target surface side of the processing object 20.

In the embodiment, a case will be described in which the calculating unit 160C calculates the amount of plasma energy to be applied to the surface on the processing target surface side of the processing object 20 (that is, the surface of the processing object 20). In the following descriptions, the surface on the processing target surface side of the processing object 20 may simply be described as the surface of the processing object 20.

For example, the storage unit 162 stores therein, in advance, surface roughness on the surface of the ink layer and the amount of plasma energy to be applied to the surface of the processing object 20 to realize the surface roughness, in an associated manner. The calculating unit 160C calculates the amount of plasma energy by reading, from the storage unit 162, the amount of the plasma energy corresponding to the surface roughness of the adjustment target area set in the setting information.

It is preferable that the calculating unit 160C calculates the amount of the plasma energy to be applied to the processing area corresponding to the adjustment target area, in accordance with at least one of the type of the processing object 20, the amount of ink applied to the processing area on the surface of the processing object 20, and the type of the ink applied to the processing area.

In the embodiment, as one example, a case will be described in which the calculating unit 160C calculates the amount of the plasma energy to be applied to the processing area corresponding to the adjustment target area, on the surface of the processing object 20, in accordance with the type of the processing object 20 (hereinafter, referred to as a paper type), the amount of ink applied to the processing area, and the type of the ink applied to the processing area.

For example, the control unit 160 stores a first table and a second table in the storage unit 162 in advance.

The first table is a table indicating a relationship between resolution and a droplet amount. FIG. 22 is a diagram illustrating an example of a data structure of the first table. As illustrated in FIG. 22, the first table is a table, in which droplet amounts (pl) corresponding to a small droplet, a medium droplet, and a large droplet, as the amounts of droplets ejected from the nozzles, are associated with each resolution of an image to be recorded.

The recording control unit 160E calculates a droplet amount corresponding to the pixel value of each of the pixels of the image data. The recording control unit 160E controls the recording unit 171 such that the calculated amounts of ink droplets are ejected from the corresponding nozzles. Therefore, the recording control unit 160E controls the recording unit 171 such that ink droplets with the droplet amount corresponding to the resolution and the density at each pixel position indicated in the image data are ejected from a corresponding nozzle at a scanning position corresponding to a pixel at each pixel position.

Therefore, the amount of ink ejected in an area corresponding to each of the pixels on the processing object 20 is determined by the resolution of a print image and the pixel value of each of the pixels defined in the image data.

The storage unit 162 stores therein the second table corresponding to each type of ink in advance. The second table is data, in which the type of ink and the amount of reference energy corresponding to a paper type are associated with each other. The amount of the reference energy is the amount of plasma energy to be applied to the surface of the processing object 20 in order to realize reference surface roughness determined in advance. The reference surface roughness is surface roughness of an ink layer and serves as a reference determined in advance. Arbitrary surface roughness may be set as the reference surface roughness.

Specifically, each of the amounts of the reference energy registered in the second table is the amount of the reference energy corresponding to a type of ink, an amount of ink, and a paper type.

FIG. 23 is a diagram illustrating an example of a data structure of the second table. FIG. 23 illustrates the second table corresponding to a single type of ink (a relationship between the amount of the ink and the amount of the reference energy corresponding to a paper type). In reality, the storage unit 162 stores therein, in advance, the second table for each of the types of ink (a table in which the amount of ink and the amount of reference energy corresponding to a paper type are registered).

It is preferable for a user to measure, in advance by using the printing apparatus 170, the amount of the plasma energy (the amount of the reference energy) to be applied to the surface of the processing object 20 in order to obtain the reference surface roughness on the surface of the ink layer, by using a plurality of paper types, a plurality of types of ink, and a plurality of different amounts of ink in advance. The control unit 160 registers, in the second table corresponding to each type of ink, the amount of the plasma energy corresponding to each of measured conditions, as the reference energy corresponding to measurement conditions (a paper type, a type of ink, and an amount of ink).

The calculating unit 160C calculates the amount of the plasma energy applied to the processing area corresponding to the adjustment target area by using the print data, the first table, and the second table corresponding to the type of ink to be used.

The calculating unit 160C extracts pixels at pixel positions overlapping the adjustment target area set in the setting information acquired by the acquiring unit 160B from among pixels of the image data contained in the print data received by the communication unit 160A. The calculating unit 160C determines an ejection amount of ink droplets (a large droplet, a medium droplet, or a small droplet) corresponding to each of the extracted pixels from the pixel value of each of the pixels. Specifically, the calculating unit 160C determines that the amount corresponds to a small droplet when the pixel value of each of the extracted pixels is smaller than a first threshold set in advance, corresponds to a medium droplet when the pixel value is equal to or greater than the first threshold and smaller than a second threshold that is greater than the first threshold, and corresponds to a large droplet when the pixel value is equal to or greater than the second threshold.

The calculating unit 160C acquires resolution for printing. The resolution may be contained in the print data and acquired by being read from the print data. The calculating unit 160C may acquire, from an input unit (not illustrated) provided in the printing apparatus 170, resolution for printing specified by the user.

The calculating unit 160C reads, from the first table (see FIG. 22), a droplet amount corresponding to the resolution and the ejection amount (a large droplet, a medium droplet, or a small droplet) of a pixel at each of the pixel positions overlapping the adjustment target area in the image data.

The calculating unit 160C calculates the amount of ink applied to the processing area corresponding to the adjustment target area, on the surface of the processing object 20. For example, the calculating unit 160C calculates, as the amount of ink applied to each of the pixel positions in the processing area, an additional value of the droplet amount to be applied to each of the pixel positions in the thickness direction (the lamination direction of the ink layer), for each of the pixel positions overlapping the adjustment target area set in the setting information in the image of the image data. Accordingly, the calculating unit 160C calculates the amount of ink applied to the processing area corresponding to the adjustment target area, on the surface of the processing object 20.

The calculating unit 160C reads the type of ink used for the printing. The calculating unit 160C reads the type of ink by receiving a signal indicating the type of ink from a sensor (not illustrated) provided in the recording unit 171, for example. The calculating unit 160C may acquire the type of ink from an input unit (not illustrated) provided in the printing apparatus 170, for example. For example, the user inputs the type of ink used for the printing by operating the input unit (not illustrated). The calculating unit 160C acquires the type of ink by receiving the type of ink from the input unit. The calculating unit 160C may read the type of ink from the print data. In this case, the print data may be configured to contain the type of ink.

The calculating unit 160C also reads the type of the processing object 20 (paper type) used for the printing. For example, the print data may be configured to contain information indicating the paper type, and the calculating unit 160C may read the paper type from the print data. In this case, the image processing apparatus 30 may generate the print data containing the paper type of a printing object in accordance with an operation of the input unit 34 by the user, for example. The calculating unit 160C may receive a signal indicating the paper type from a sensor (not illustrated) provided in a storage (not illustrated), which is provided in the printing apparatus 170 and stores therein the processing object 20. In this case, the calculating unit 160C may acquire the paper type by reading the signal indicating the paper type received from the sensor.

The calculating unit 160C reads the amount of reference energy corresponding to the acquired paper type and the calculated amount of ink from the second table (see FIG. 23) corresponding to the acquired type of ink, for each of the pixel positions. Therefore, the calculating unit 160C calculates the amount of the reference energy to be applied to the processing area corresponding to the adjustment target area, on the surface of the processing object 20.

Then, the calculating unit 160C reads information indicating the intensity of the surface roughness corresponding to the adjustment target area indicated by the setting information. For example, the intensity of the surface roughness of "low intensity" indicates 50% (a half) of the reference energy, "normal intensity" indicates the reference energy (that is, 100% (the same magnification)), and "high intensity" indicates 150% (one and a half) of the reference energy. These values are arbitrary, and may be set appropriately or changed appropriately according to an operation instruction by the user.

The calculating unit 160C calculates, as the amount of the plasma energy to be applied to each of the pixel positions of the processing area, a value obtained by multiplying the amount of the reference energy calculated for each processing target area (that is, a pixel position of each of the pixels in the processing target area) by a value (50% (a half), 100% (the same magnification), or 150% (one and a half)) corresponding to the intensity of the surface roughness set in the corresponding adjustment target area.

Therefore, for example, in the processing area corresponding to the adjustment target area in which the intensity of the surface roughness of "low intensity" is set, the amount of plasma energy corresponding to a half of the calculated amount of the reference energy is set. Further, for example, in the processing area corresponding to the adjustment target area in which the intensity of the surface roughness of "normal intensity" is set, the amount of plasma energy corresponding the calculated amount of the reference energy is set. Furthermore, for example, in the processing area corresponding to the adjustment target area in which the intensity of the surface roughness of "high intensity" is set, the amount of plasma energy corresponding to twice of the calculated amount of the reference energy is set.

As described above, the calculating unit 160C calculates the amount of the plasma energy for obtaining the set surface roughness on the surface of the ink layer formed on a processing area corresponding to the adjustment target area indicated by the setting information on the surface of the processing object 20, for each adjustment target area (each processing area).

The plasma control unit 160D controls the plasma processing unit 101 to perform the plasma processing on the processing area corresponding to the adjustment target area of the ink layer set in the setting information on the surface of the processing object 20, with a corresponding amount of the plasma energy calculated by the calculating unit 160C.

In the embodiment, a case will be described in which the plasma control unit 160D controls the plasma processing unit 101 to perform the plasma processing on the processing area corresponding to the adjustment target area of the ink layer on the surface of the processing object 20 with the corresponding amount of the plasma energy calculated by the calculating unit 160C.

The amount of the plasma energy is, as described above, the amount of energy of plasma to cause pigment contained in an adjustment target ink layer to aggregate such that the surface roughness set in the setting information is obtained.

The plasma control unit 160D controls the plasma processing unit 101 to perform the plasma processing on a corresponding processing area with the amount of the plasma energy that is calculated for each of the processing areas corresponding to the adjustment target area. For example, the plasma control unit 160D controls selection of a discharge electrode to which a voltage is applied among the discharge electrodes 101*a* to 101*d* and 101*w* to 101*z* provided in the plasma processing unit 101, controls a voltage value of the voltage applied to the discharge electrode, controls a voltage application time, controls a speed of the carriage 172 in the sub-scanning direction, and controls a feed timing of the processing object 20 in the main-scanning direction in a combined manner, thereby causing the plasma processing to be performed on the processing area corresponding to the adjustment target area, on the surface of the processing object 20 with a calculated corresponding amount of plasma energy.

Further, when the setting information contains a plurality of adjustment target areas, the plasma control unit 160D performs plasma processing on each of the processing areas on the processing object 20 corresponding to the adjustment target areas, with the amount of the plasma energy for obtaining the surface roughness on the surfaces of ink layers formed on the respective processing areas.

Therefore, the surface of the ink layer formed with ink on the processing area subjected to the plasma processing can be adjusted to have desired surface roughness.

Figure 24:
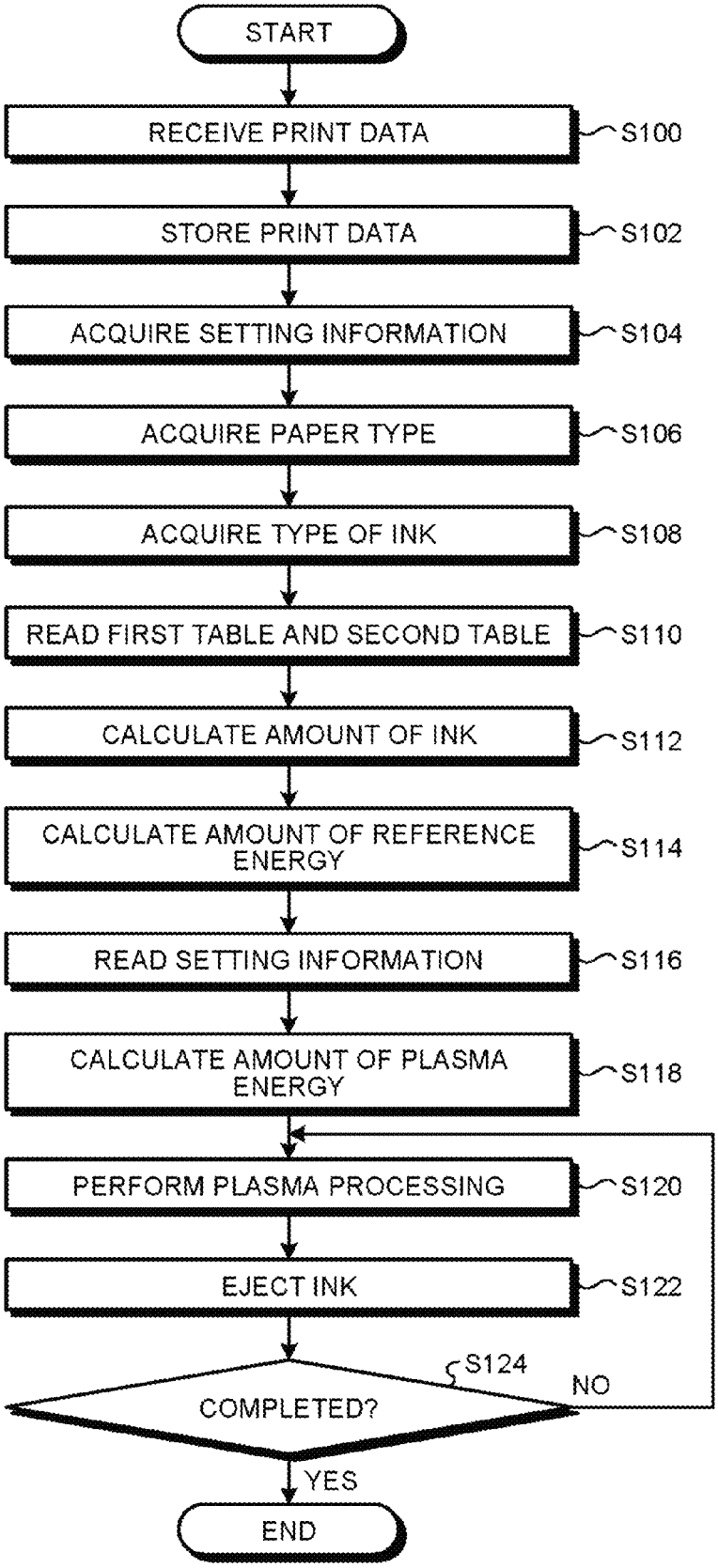
FIG. 24 is a flowchart illustrating the flow of a printing process.

The flow of a printing process performed by the printing apparatus 170 will be described below. FIG. 24 is a flowchart illustrating the flow of the printing process performed by the printing apparatus 170.

First, the communication unit 160A receives print data from the image processing apparatus 30 (Step S100). The communication unit 160A stores the received print data in the storage unit 162 (Step S102).

The acquiring unit 160B acquires setting information and image data from the print data (Step S104).

The calculating unit 160C acquires a paper type used for printing (the type of the processing object 20) (Step S106). The calculating unit 160C acquires a type of ink used for printing (Step S108).

The calculating unit 160C reads the first table (see FIG. 22) stored in the storage unit 162 and the second table (see FIG. 23) corresponding to the acquired type of the ink (Step S110).

The calculating unit 160C calculates the amount of ink applied to a processing area corresponding to the adjustment target area, on the surface of the processing object 20 by using the image data and the setting information acquired at Step S104 and by using the first table read at Step S110 (Step S112).

The calculating unit 160C reads, from the second table (see FIG. 23) corresponding to the type of ink acquired at Step S108, the amount of reference energy corresponding to the paper type acquired at Step S106 and the amount of the ink calculated at Step S112. Through the process, the calculating unit 160C calculates the amount of the reference energy to be applied to the processing area corresponding to each of the adjustment target areas (Step S114).

The calculating unit 160C reads information indicating the intensity of the surface roughness corresponding to the adjustment target area indicated in the setting information (Step S116). The calculating unit 160C calculates, for each processing area, the amount of the plasma energy for obtaining the surface roughness set in the setting information on the surface of the ink layer formed on the processing area corresponding to the adjustment target area (Step S118). Specifically, as described above, the calculating unit 160C calculates, as the amount of the plasma energy to be applied to the processing area, a value obtained by multiplying the amount of the reference energy of each processing area calculated at Step S114 by a value indicating the intensity of the surface roughness set for the corresponding adjustment target area indicated in the setting information (the value is 1.5 for "high intensity", 1 for "normal intensity", or 0.5 for "low intensity" as described above).

The plasma control unit 160D controls the plasma processing unit 101 to perform the plasma processing on each of the corresponding processing areas on the processing target surface side of the processing object 20, with the amount of the plasma energy calculated at Step S118 (Step S120).

The recording control unit 160E causes the recording unit 171 to eject ink droplets to a corresponding position in accordance with the density value of each of the pixels indicated by the image data (Step S122).

In the processes at Step S120 to Step S122, the control unit 160 controls scanning of the head unit 173 and conveyance of the processing object 20.

The control unit 160 repeats the processes from Step S120 to Step S122 (NO at Step S124) until the image of the image data contained in the print data is formed (YES at Step S124). If a determination result is positive at Step S124 (YES at Step S124), the routine is finished.

As described above, the printing apparatus 170 according to the embodiment includes the plasma processing unit 101, the recording unit 171, the acquiring unit 160B, and the plasma control unit 160D. The plasma processing unit 101 performs plasma processing on the processing target surface side of the processing object 20. The recording unit 171 ejects ink. The acquiring unit 160B acquires setting information, in which an adjustment target area for adjusting surface roughness and surface roughness of the adjustment target area on the surface of the ink layer are set. The plasma control unit 160D controls the plasma processing unit 101 to perform the plasma processing on the processing area corresponding to the adjustment target area, on the processing target surface side of the processing object 20, with the amount of the plasma energy for obtaining the set surface roughness on the surface of the ink layer formed on the processing area.

Therefore, the printing apparatus 170 of the embodiment can easily adjust the surface roughness on the surface of the ink layer formed on the processing object 20 to desired surface roughness.

Further, the printing apparatus 170 can easily adjust the surface roughness on the surface of the ink layer to desired surface roughness, so that it is possible to easily adjust the surface roughness of an arbitrary area on the surface of the ink layer or to adjust the glossiness of a white ink layer.

Specifically, with an increase in the surface roughness of the ink layer, more light is diffusely reflected. Therefore, it is possible to apply matte effect, such as a delustering effect, to the adjustment target area desired by a user on the surface of the ink layer. Further, by adjusting the amount of the plasma energy, it is possible to apply gloss finish with the increased glossiness on the adjustment target area desired by a user on the surface of the ink layer.

If the transparent processing object 20 is used and a printed material is applied to an electric sign board irradiated with light from a surface opposite to the surface on which the ink layer is formed, the ink layer on the printed material is viewed through the transparent processing object 20. Therefore, by adjusting the surface roughness on the surface of the ink layer by adjusting the amount of the plasma energy, it is possible to adjust the transmission amount of light that transmits through the printed material. Consequently, it is possible to realize gradation expression by adjusting the transmission amount of light. Specifically, by causing the transmission light of a back light to be diffusely reflected, the transmission amount of light is adjusted and thus gradation can be adjusted. In particular, by adjusting the surface roughness on the surface of a white ink layer, gradation can be applied easily.

Further, density unevenness, which is viewed when ink ejection unevenness (in particular, white ink) is intensified by light and which is disadvantageous for application to an electric sign board, can be reduced by the effect of light scattering by intensifying (increasing) the surface roughness of a white ink layer.

Further, the printing apparatus 170 of the embodiment adjusts the surface roughness on the surface of the ink layer formed on the processing object 20 by performing the plasma processing on the processing object 20, rather than by adjusting the surface roughness of the processing object 20 through the plasma processing. Therefore, even if the smoothness of the surface of the processing object 20 is not changed by the plasma processing, it is possible to easily adjust the surface roughness of the ink layer by improving the aggregation of ink by the plasma processing.

Incidentally, the plasma processing unit 101 may detect the processing area subjected to the plasma processing by the plasma processing unit 101 during scanning by the head unit 173, and output a detection result to the control unit 160. The control unit 160 may correct the amount of the plasma energy of the plasma processing unit 101 so that a desired plasma processing result can be obtained.

In the embodiment, a case has been described in which the amount of the reference energy is registered in the second table (see FIG. 23). However, it may be possible to register conditions to realize plasma processing with the amount of the reference energy, instead of registering the amount of the reference energy. For example, it may be possible to register, in the second table, a value in which a drive frequency of the discharge electrode of the plasma processing unit 101, a voltage value of the voltage to be applied to a discharge electrode, a voltage application time, the speed of the carriage 172 in the sub-scanning direction, and a feed timing of the processing object 20 in the main-scanning direction are combined, instead of the amount of the reference energy.

Second Embodiment

In the above described embodiment, a case has been described in which the calculating unit 160C calculates the amount of plasma energy of plasma applied to the surface of the processing object 20. In the above described embodiment, a case has been described in which the plasma control unit 160D performs plasma processing on a processing area on the surface of the processing object 20.

However, it is sufficient that the plasma control unit 160D performs plasma processing on the processing target surface side of the processing object 20, and a layer to be subjected to the plasma processing is not limited to the surface of the processing object 20.

Specifically, it is sufficient that the plasma control unit 160D performs the plasma processing on a surface of a layer located closer to the processing object 20 than an ink layer that is a target of surface roughness adjustment.

As described in the above embodiment, the inventors have found that, by performing the plasma processing on the surface of the processing object 20, the speed of aggregation of the pigment contained in the ink ejected on the processing area subjected to the plasma processing on the processing object 20 is increased. Further, the inventors have found that, by performing the plasma processing on the ink layer formed on the surface of the processing object 20, resin (for example, siloxane or polyether) contained in the ink reacts, and the speed of aggregation of the pigment contained in the ink ejected on the ink layer is also increased.

Therefore, when the recording unit 171 laminates a plurality of ink layers on the processing target surface side of the processing object 20, the plasma control unit 160D may control the plasma processing unit 101 to perform plasma processing on a processing area corresponding to an adjustment target area on at least one of the surface of the processing object 20 and one or more layers located closer to the processing object 20 than an ink layer that is a target of surface roughness adjustment (hereinafter, this ink layer is referred to as an adjustment target layer) among the ink layers, by using a certain amount of plasma energy for obtaining the set surface roughness.

In this case, the print data may be configured to include print condition information indicating the number of ink layers to be formed and an ink layer to be adjusted.

For example, the control unit 32 of the image processing apparatus 30 (see FIG. 19) displays an input screen of a printing method and an adjustment target layer that is an ink layer to be adjusted on the display unit 36, and receives input of the printing method from a user. The image processing apparatus 30 stores therein the number of ink layers corresponding to each printing method in advance.

For example, the control unit 32 of the image processing apparatus 30 displays, on the display unit 36, a list of printing methods such as normal printing, underlay printing, overlay printing, three layer printing, and white ink printing as described in the first embodiment, and displays, on the display unit 36, character information to request input of an adjustment target layer. A user selects a printing method and an adjustment target layer by operating the input unit 34. Further, similarly to the first embodiment, the user inputs an adjustment target area for adjusting surface roughness of the adjustment target layer by operating the input unit 34.

The receiving unit 32B of the image processing apparatus 30 receives, from the input unit 34, setting information containing the printing method, the adjustment target layer, the adjustment target area on the adjustment target layer, and surface roughness of the adjustment target area.

The generating unit 32C of the control unit 32 generates print data containing image data in the raster format and setting information in the raster format, which are generated in the same manner as in the first embodiment.

When the printing method contained in the setting information on the print data indicates a printing method for forming a plurality of ink layers (underlay printing, overlay printing, or three layer printing (see FIG. 18)), the plasma control unit 160D of the printing apparatus 170 (see FIG. 21) determines that an image with a plurality of laminated ink layers is to be recorded.

When determining that the image with a plurality of laminated ink layers is to be recorded, the plasma control unit 160D controls the plasma processing unit 101 to perform plasma processing on a processing area corresponding to an adjustment target area on at least one of the surface of the processing object 20 and one or more layers located closer to the processing object 20 than an ink layer that is a target of surface roughness adjustment among the ink layers, by using a certain amount of plasma energy for obtaining the set surface roughness on the surface of the adjustment target layer formed on the processing area.

In this case, the storage unit 162 stores therein, in advance, a corresponding second table (a table in which the amount of the reference energy corresponding to the amount of ink and a paper type is registered) for each combination of a printing method, a layer as an adjustment target layer to be subjected to plasma processing (including the surface of the processing object 20), and a type of ink, instead of the second table corresponding to the type of ink as illustrated in FIG. 23 (a table in which the amount of reference energy corresponding to the amount of ink and a paper type is registered). The layer to be subjected to the plasma processing (hereinafter, referred to as a plasma processing target layer) may be the surface of the processing object 20 or the surface of an ink layer located closer to the processing object 20 than the adjustment target layer.

The amount of the reference energy that meets the above described conditions is measured and registered in a corresponding second table in advance.

The calculating unit 160C calculates, for each plasma processing target layer, the amount of ink applied to the processing area corresponding to the adjustment target area in the plasma processing target layer, from the resolution, the image data, and the first table (see FIG. 22). The amount of ink is calculated in the same manner as in the first embodiment.

Further, the calculating unit 160C reads the printing method, the plasma processing target layer corresponding to the adjustment target layer, the type of ink, and a corresponding second table, and reads the amount of the reference energy corresponding to the amount of ink and the paper type in the second table. Through this process, the calculating unit 160C calculates the amount of the reference energy of plasma to be applied to the processing area corresponding to the adjustment target area in the plasma processing target layer.

The calculating unit 160C calculates the amount of the plasma energy to be applied to the processing area in the plasma processing target layer by using the calculated reference energy and the intensity of the surface roughness corresponding to the adjustment target area indicated in the setting information, in the same manner as in the first embodiment.

The plasma control unit 160D controls the plasma processing unit 101 to perform plasma processing on a processing area corresponding to an adjustment target area on the plasma processing target layer from among the surface of the processing object 20 and at least one of layers located closer to the processing object 20 than the ink layer as a target of surface roughness adjustment among the ink layers, with the amount of the plasma energy corresponding to each plasma processing target layer and each processing area calculated by the calculating unit 160C.

In this case, the plasma control unit 160D controls a timing such that the plasma processing is performed on the surface of the set plasma processing target layer on any of the surface of the processing object 20 and one or more ink layers formed on the processing object 20, with the amount of the plasma energy calculated by the calculating unit 160C, in accordance with a timing at which the recording unit 171 ejects ink droplets to form the ink layers.

As described above, when a plurality of ink layers are laminated, the plasma control unit 160D may control the plasma processing unit 101 to perform plasma processing on a processing area corresponding to an adjustment target area on at least one of the surface of the processing object 20 and one or more ink layers located closer to the processing object 20 than a layer that is a target of surface roughness adjustment among the ink layers, with the amount of the plasma energy for obtaining the set surface roughness on the surface of the adjustment target layer formed on the processing area.

Third Embodiment

Hardware configurations of the image processing apparatus 30 and the printing apparatus 170 will be described below.

Figure 25:
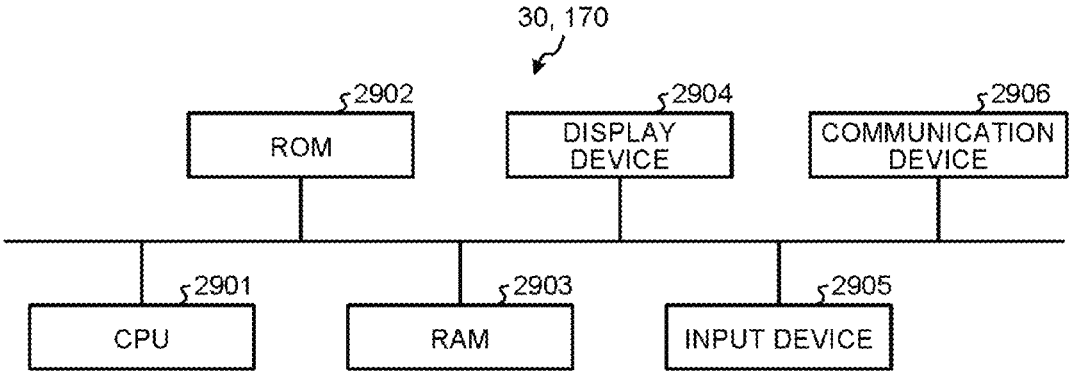
FIG. 25 is a hardware configuration diagram of the image processing apparatus and the printing apparatus.

FIG. 25 is a hardware configuration diagram of the image processing apparatus 30 and the printing apparatus 170. The image processing apparatus 30 and the printing apparatus 170 mainly includes, as a hardware configuration, a CPU 2901 that controls the entire apparatus, a ROM 2902 that stores therein various kinds of data and various programs, a RAM 2903 that stores therein various kinds of data and various programs, an input device 2905 such as a keyboard or a mouse, a display device 2904 such as a display, and a communication device 2906, and has a hardware configuration using a normal computer.

A program executed by the image processing apparatus 30 and the printing apparatus 170 of the above described embodiments is provided as a computer program product by being recorded in a computer-readable recording medium, such as a compact disc (CD)-ROM, a flexible disk (FD), a compact disc-recordable (CD-R), or a digital versatile disk (DVD), in a computer-installable or a computer-executable file.

Further, the program executed by the image processing apparatus 30 and the printing apparatus 170 of the above described embodiments may be stored in a computer connected to a network, such as the Internet, and provided by being downloaded via the network. Furthermore, the program executed by the image processing apparatus 30 and the printing apparatus 170 of the above described embodiments may be provided or distributed via a network, such as the Internet.

Moreover, the program executed by the image processing apparatus 30 and the printing apparatus 170 of the above described embodiments may be provided by being incorporated in a ROM or the like in advance.

The program executed by the image processing apparatus 30 and the printing apparatus 170 of the above described embodiments has a module structure including the above described units. As actual hardware, a CPU (processor) reads the program from the above described storage medium and executes the program, so that the units are loaded on a main storage device and generated on the main storage device.

According to an embodiment, it is possible to easily adjust surface roughness on the surface of an ink layer formed on a processing object to desired surface roughness.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A printing apparatus comprising:

a plasma processing unit that performs plasma processing on a processing target surface side of a processing object;

a recording unit that ejects ink on the processing target surface side of the processing object;

an acquiring unit that acquires setting information, in which an adjustment target area for adjusting surface roughness and surface roughness of the adjustment target area on a surface of an ink layer formed with the ink are set; and a plasma control unit that controls the plasma processing unit to perform plasma processing on a processing area corresponding to the adjustment target area, on the processing target surface side of the processing object, with an amount of plasma energy for obtaining the set surface roughness on the surface of the ink layer formed on the processing area.

2. The printing apparatus according to claim 1, wherein the acquiring unit acquires the setting information, in which a plurality of adjustment target areas and surface roughness of each of the adjustment target areas on the surface of the ink layer are set, and the plasma control unit controls the plasma processing unit to perform plasma processing on each of the processing areas corresponding to each of the adjustment target areas, on the processing target surface side of the processing object, with an amount of plasma energy for obtaining set surface roughness on the surface of the ink layer formed on each of the processing areas.

3. The printing apparatus according to claim 1, wherein the plasma control unit controls the plasma processing unit to perform plasma processing on the processing area on the surface of the processing object, with the amount of plasma energy for obtaining the specified surface roughness on the surface of the ink layer formed on the processing area.

4. The printing apparatus according to claim 1, wherein when the recording unit laminates a plurality of ink layers on the processing target surface side of the processing object, the plasma control unit controls the plasma processing unit to perform plasma processing on the processing area corresponding to the adjustment target area, on at least one of a surface of the processing object and one or more layers located closer to the processing object than an adjustment target layer that is an ink layer as a target of surface roughness adjustment among the ink layers, with an amount of plasma energy for obtaining the set surface roughness on a surface of the adjustment target layer formed on the processing area.

5. The printing apparatus according to claim 1, further comprising:

a calculating unit that calculates an amount of plasma energy for obtaining the set surface roughness on the surface of the ink layer formed on the processing area corresponding to the adjustment target area, on the processing target surface side of the processing object, in accordance with one of a type of the processing object, an amount of ink applied to the processing area, and a type of the ink applied to the processing area, wherein the plasma control unit controls the plasma processing unit to perform plasma processing on the processing area corresponding to the adjustment target area, on the processing target surface side of the processing object, with the calculated amount of plasma energy corresponding to the adjustment target area.

6. The printing apparatus according to claim 1, wherein the amount of the plasma energy is an amount of energy of plasma for causing pigment contained in the ink layer to aggregate such that the surface roughness set in the setting information is obtained.

7. A printing system comprising:

an image processing apparatus; and a printing apparatus capable of communicating with the image processing apparatus, wherein the image processing apparatus includes:

a receiving unit that receives setting information containing an adjustment target area for adjusting surface roughness and surface roughness of the adjustment target area on a surface of an ink layer formed on a processing target surface side of a processing object; and a generating unit that generates print data containing the setting information and image data of an image formed with ink, and the printing apparatus includes:

a plasma processing unit that performs plasma processing on the processing target surface side of the processing object;

a recording unit that ejects ink to the processing target surface side of the processing object based on the image data;

an acquiring unit that acquires the setting information; and a plasma control unit that controls the plasma processing unit to perform plasma processing on a processing area corresponding to the adjustment target area, on the processing target surface side of the processing object, with an amount of plasma energy for obtaining the set surface roughness on the surface of the ink layer formed on the processing area.

8. A printed material manufacturing method performed by a printing apparatus including a plasma processing unit that performs plasma processing on a processing target surface side of a processing object, and a recording unit that ejects ink to the processing target surface side of the processing object, the printed material manufacturing method comprising:

acquiring setting information, in which an adjustment target area for adjusting surface roughness and surface roughness of the adjustment target area on a surface of an ink layer formed with the ink are set; and controlling the plasma processing unit to perform plasma processing on a processing area corresponding to the adjustment target area, on the processing target surface side of the processing object, with an amount of plasma energy for obtaining the set surface roughness on the surface of the ink layer formed on the processing area.

* * * * *